United States Patent [19]

Leanna et al.

[11] 4,280,669

[45] Jul. 28, 1981

[54] AUTOMATIC WEB REWINDER FOR TENSIONED WEB

[75] Inventors: Dale D. Leanna, Little Suamico; Allen R. Jorgensen, Abrams; Gerald W. Terp, Green Bay; John LaHaye, Green Bay; Kenneth L. Nehring, Green Bay, all of Wis.

[73] Assignee: Magna-Graphics Corporation, Oconto Falls, Wis.

[21] Appl. No.: 113,465

[22] Filed: Jan. 21, 1980

[51] Int. Cl.[3] ..... B65H 19/20; B65H 35/04

[52] U.S. Cl. ..... 242/56 A; 242/56.6

[58] Field of Search ..... 242/56 A, 56 R, 67.1 R, 242/67.2, 67.3, 56.6, 64

[56] References Cited

U.S. PATENT DOCUMENTS

| | | | |
|---|---|---|---|
| Re. 28,353 | 3/1975 | Nystrand | 242/56 A |
| 2,682,379 | 6/1954 | Piper | 242/56 R |
| 3,179,348 | 4/1965 | Nystrand | 242/56 A |
| 3,409,243 | 11/1968 | Wasserlein | 242/64 |
| 3,642,221 | 2/1972 | Hellemans | 242/56 R |
| 3,687,387 | 8/1972 | Hilgemann | 242/56 A |
| 3,720,381 | 3/1973 | Rehme | 242/56 R |
| 3,796,388 | 3/1974 | Davis | 242/56 A |

*Primary Examiner*—Edward J. McCarthy
*Attorney, Agent, or Firm*—James E. Nilles

[57] ABSTRACT

In web rewinding apparatus for producing hard-wound individual rolls, a knife for cutting through the web is carried for substantially radial extension and retraction by a cutoff roll which cooperates with a bed roll around which the web has substantial wrap. When extended, the knife enters a longitudinal slot in the bed roll, in which there is a row of fixed pins. A web impalement pusher bar, extended from the cutoff roll along with the knife, impales the web onto the pins. Transfer pads carried by the bed roll extend, to detach the web from the pins and clamp it against a new core. Cores onto which web is wound are supported by six mandrels spaced circumferentially around a turret that carries them, in turn, to each of six fixed stations. Coaxial with each mandrel on the turret is a rotatable driver and a normally disengaged clutch which, when engaged, transmits rotation of its driver to its mandrel. Alternate drivers around the turret are driven from one motor, the remaining drivers by a second motor. Each clutch is engaged as its mandrel moves into an acceleration station. Shortly before a mandrel moves out of the acceleration station to a winding station it is brought up to web speed; and while it is at the winding station its motor applies a constant torque on it to maintain tension on the web. A driven rider roll augments web tension. Turret indexing is controlled by a pulse generator and a resettable counter that is adjustable to adjust length of web wound onto an individual roll.

33 Claims, 19 Drawing Figures

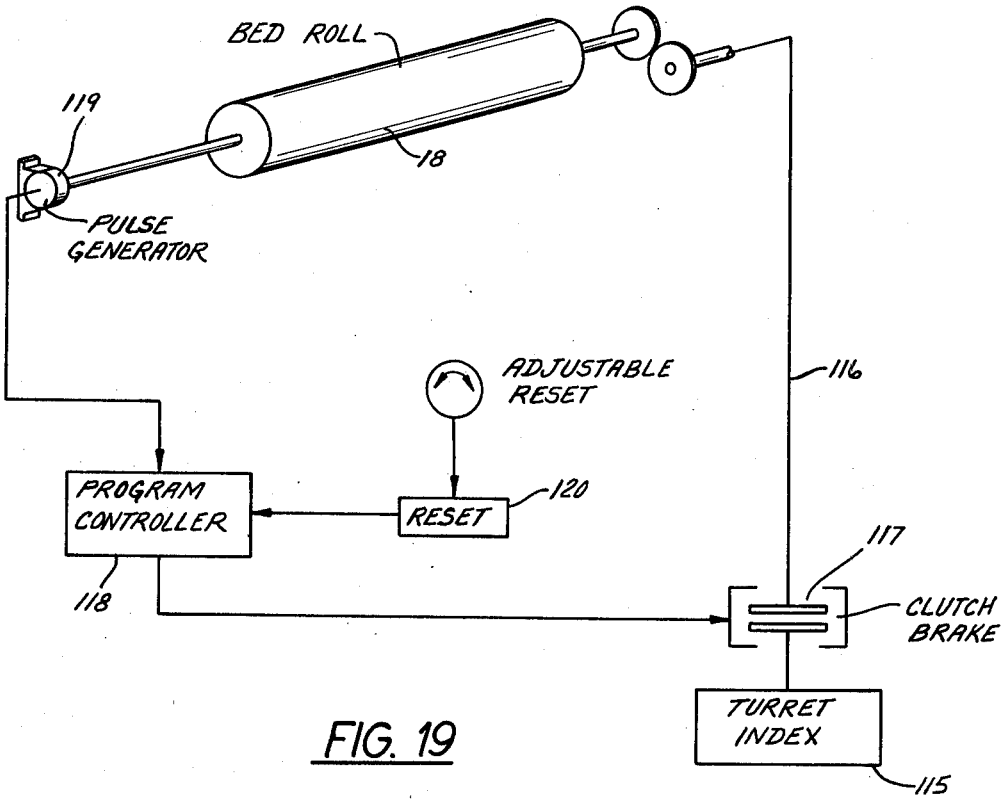
FIG. 19
FIG. 14
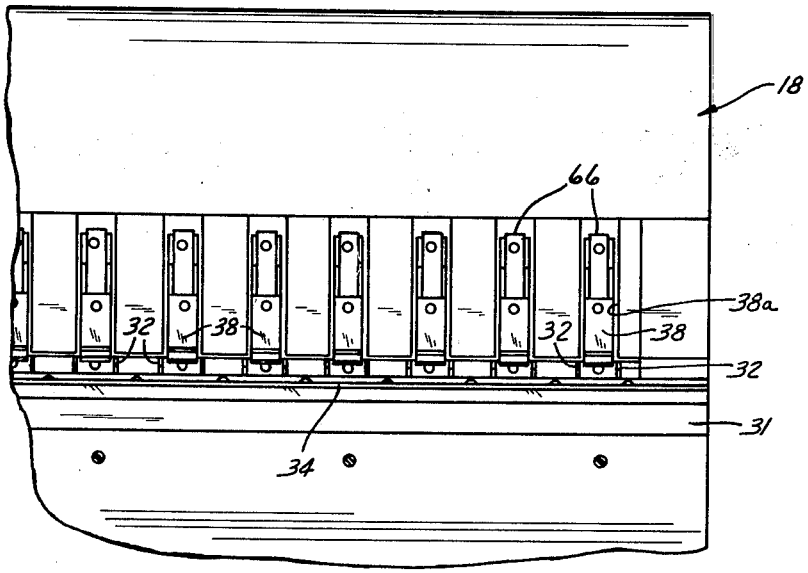

AUTOMATIC WEB REWINDER FOR TENSIONED WEB

FIELD OF THE INVENTION

This invention relates to automatic web rewinding machines whereby a web of paper or the like is unwound from a large parent roll and is rewound into smaller individual rolls; and the invention is more particularly concerned with an automatic web rewinder with which tension can be maintained upon a web being rewound into a small roll so that the resultant small roll will be hard-wound and will contain a maximum amount of web material for a given wound diameter.

BACKGROUND OF THE INVENTION

Paper stock material such as the material for paper towels and toilet tissue is manufactured as a wide continuous web that is wound onto very large parent rolls. Subsequently, in a rewinding machine, each such parent roll is unwound and is simultaneously rewound onto tubular cores to form numerous individual rolls. The rewinding operation usually involves a simultaneous lengthwise slitting of the web as it is unwound from the parent roll, to reduce it to the widths desired for the individual rolls. During the rewinding operation the web may also be embossed, and it may be perforated across its width, at regular intervals along its length, to define readily detachable rectangles in the individual rolls.

The rewinding operation should obviously take place at the highest possible speed, and it is also necessary that each individual roll should be wound both to a specified diameter and with a specified count or footage. The problem of meeting both diameter and footage or count requirements is particularly severe in the rewinding of so-called hard wound rolls of paper towels and the like that are intended for industrial and commercial use, where the objective is to produce an individual roll small enough to fit into a cabinet or dispenser of a given size but having a specified high count or footage. To produce such hard-wound rolls, the web must be under some tension during rewinding, and the need for maintaining such tension tends to complicate certain problems that are always presented by high-speed automatic web rewinding machines.

In an automatic rewinding machine, a tubular core is loaded onto a winding mandrel before the winding operation begins, to provide cores onto which individual rolls are to be wound. The winding machine usually comprises a rotatable turret by which several mandrels are carried for orbital motion through successive stations at which mandrel loading, core preparation, winding, and mandrel unloading are performed.

After the core has been loaded onto a mandrel, it is cut into shorter individual core lengths, and at about the same time an adhesive coating is applied to the core. The mandrel and core are then brought up to a rotational speed such that the peripheral speed of the core substantially matches the linear speed of the web. As the winding of one roll is finished, the web must be cut through to separate it from the finished roll, and the leading end portion of the web that results from this cutting operation must be attached to a new core.

Cutting of the web and transfer of the winding operation from a completed roll to a new core must take place during a very brief and critical interval. The speed at which cutting and transfer can be successfully accomplished essentially determines the rate at which the entire rewinding procedure can take place, because it is not practicable to slow down the web during the critical interval inasmuch as the parent roll from which it is unwound is too massive to be subjected to substantial short term accelerations and decelerations.

In early automatic rewinding machines, as exemplified by U.S. Pat. No. 2,769,600 to Kwitek et al, the web was cut through at a location between a fully-wound individual roll that was moving out of the winding station and a new core that was moving into the winding station. Such web severing was effected by means of a radially extensible and retractable knife blade that was carried by a large diameter bed roll around which the web had a partial wrap. When extended from the bed roll, the knife blade cooperated with other extensible means on the bed roll for engaging the web against the new core. The knife blade had to be in its retracted position as it passed the new core and had to be fully extended immediately after it passed the new core and before it was carried orbitally past the fully wound core, which is to say that the knife blade had to move from its fully retracted position to its fully extended position within a relatively small fraction of a turn of the bed roll. Sufficiently rapid movement of the knife blade was feasible if the bed roll was rotating rather slowly. But with web speeds on the order of thousands of feet per minute, and correspondingly high rotational speeds of the bed roll, it became difficult to achieve the necessary synchronization of knife movements with bed roll rotation, and the rapid movements of the knife relative to the bed roll imposed high stresses upon the machine.

U.S. Pat. No. 2,585,226 to Christman disclosed web winding mechanism wherein the web was cut through at a location ahead of the new core and was carried to engagement with the new core by a feed roll to which the leading portion of the web was caused to adhere by suction. Suction adhesion, while satisfactory in low-speed operations, does not lend itself to operation at extremely high speeds of feed roll rotation because suction cannot be applied and relieved in the very small fractions of a second that are involved in web severing and transfer. Furthermore, the expedient taught by the Christman patent does not seem to be suitable for hard roll winding because it is doubtful whether web tension could be maintained during an interval in which the web was held to a feed roll only by suction.

The later U.S. Patent to Nystrand et al, U.S. Pat. No. 3,179,348, reissued as U.S. Pat. No. Re. 28,353, disclosed another type of apparatus in which the web was cut through before it was brought into contact with the new core and wherein its free leading portion that resulted from the cut was carried through a fraction of a revolution by the bed roll, which engaged it against the new core. Although the apparatus of Nystrand et al would seem to be better adapted for highspeed hard roll winding than that of Christman, it was apparently not satisfactory for that purpose in actual practice.

In the apparatus of the Nystrand et al patent, the web ran in partially wrapped engagement with a driven bed roll that had a longitudinally extending recess in its surface and had parallel blade elements that were extensible out of the recess to engage the web for making the cut therethrough. Cutting was done by a knife blade that was fixed on a chopper roll rotating adjacent to the bed roll, which knife blade was received between the parallel blade elements on the bed roll. The cut was made through a part of the web that had not yet arrived at the new core. In order to maintain control over the free leading portion of the web that resulted from the cut through it, the bed roll carried a set of sharp pins that were radially extended from it along with the parallel blade elements, and these pins, in cooperation with a resilient pad on the chopper roll surface, impaled the leading portion of the web to connect it to the bed roll.

After such impalement, the blade elements and the pins began to retract so that they could clear the new core that they were now approaching, and a set of finger-like pressure pads then extended radially from the bed roll to disengage the web from the pins and press the web into engagement with the new core.

The blade elements and the pins were carried by one assembly that extended and retracted relative to the bed roll, and the pressure pads were carried by another such assembly. Each of these assemblies was eccentrically carried on a shaft that rotated through a partial turn in each direction for the respective extending and retracting motions. To avoid interference between the pin and blade element assembly and the pressure pad assembly, the shaft for the pressure pad assembly had to be located circumferentially behind those pads relative to the direction of bed roll rotation. Owing to this rearward location of the axis about which the pressure pads made their pivoting extension, that portion of the surface of each pressure pad that was effective to press the web against the new core had to be curved on a relatively small radius; and this meant that there were only a very few degrees of bed roll rotation in which the transfer pads could be effective to engage the web firmly against a new core. However, the point in bed roll rotation at which the web became disengaged from the pins was somewhat indefinite, because the curvature of the web engaging surfaces of the pressure pads did not make for a positive detachment of the web from the pins, and the rearward component of extending motion of the pressure pads carried them away from the pins and thus decreased their effectiveness for web release. To further diminish the possibility of effecting release of the web from the pins at a well defined point in bed roll rotation, Nystrand et al expressly recommended that the pressure pads extend "relatively slowly". Under all of these circumstances there could be no assurance that the web would be firmly engaged against the new core substantially simultaneously with its disengagement from the pins.

If the web was not under tension—and it was not meant to be with the Nystrand et al apparatus—small errors in the timing of transfer of the web from the pins to the new core were of no practical consequence. But with a lengthwise tensioned web, there can be no delay between release of the web from its impalement on the pins and its engagement against the new core, and such engagement must be firm and positive. The type of action of the pressure pads that is needed for winding with a tensioned web can be assured only if the pins and the pressure pads are so arranged that pressure pad extension does not have to be timed to within very small limits of bed roll rotation. Such extremely accurate timing would have been necessary in order to use the Nystrand et al apparatus for tensioned web winding, but would have been practically unattainable with it, owing to the arrangement of its mechanism.

Another feature of the Nystrand et al arrangement that made it particularly unsuitable for the winding of a tensioned web was that the parallel blade elements and the pins moved radially outwardly against the web and thus had to force the web away from the bed roll and into engagement with the knife blade on the chopper roll. With an untensioned web no great force was needed to effect this extending motion and web displacement, but with a tensioned web very high forces would have had to be applied to the assembly comprising the blade elements and pins in order to drive it out against web tension.

Those skilled in the art apparently did not appreciate that the above explained deficiencies made the Nystrand et al apparatus unsuitable for tensioned web winding. It clearly was not obvious to them how to overcome those deficiencies.

There is no suggestion in any of the above discussed prior patents concerning another and very important problem that is posed by the need for maintaining tension upon a web during hard roll rewinding: the torque applied to the web winding mandrel must be controlled for maintenance of web tension. In prior automatic rewinding machines the winding mandrel was driven in such a manner that web tension tended to control rotational speed of the winding mandrel, and there was no attempt to control applied torque. As can be seen from the above mentioned patents, the usual prior arrangement was to mount a number of core-carrying mandrels for free rotation on the turret by which the mandrels were carried from station to station in orbital motion. Each mandrel had its own coaxial drive sheave. As a mandrel was carried towards the winding station, its drive sheave came into engagement with a stretch of a drive belt that was running at a constant speed. Engagement of the sheave against the drive belt served as a clutch connection by which the mandrel was brought up to winding speed and which tended to rotate the mandrel at a constant speed as long as the drive sheave remained in engagement with the belt. Since the sheave could slip relative to the drive belt—and was intended to do so—there could be no really accurate control of the torque applied to the mandrel, and consequently there was no possibility of maintaining the web tension needed for hard roll winding.

The problem of providing a mandrel drive system for hard roll winding is complicated by the fact that a high speed automatic web rewinder must comprise several mandrels. During a time when web tensioning torque is being applied to a mandrel at a winding station, to drive it for web winding, a mandrel at a proceding station must be accelerated from a stop, to bring the peripheral speed of a core thereon into substantial match with the existing speed of web advance. At that same time, still another mandrel, carrying a completely wound roll, is being decelerated to a stop in preparation for unloading; and meanwhile other mandrels must remain stationary. The problem, of course, is to provide the requisite modes of drive for the respective mandrels at the proper times, and to do so without interfering with indexing rotation of the turret or requiring costly or unwieldy drive means.

When the web is first transferred to a new core, it is secured to the core by adhesive that cannot support a high web tension, and the mandrel has to make several turns before the web has sufficient wrap around the core to allow tension to be applied to the web from the core. In practical effect this means that web tension must in some manner be relaxed during the first few turns of winding onto a new core, and must thereafter be picked up and maintained by means of the torque applied to the core. Such controlled change in web tension should of course be accomplished in a simple manner.

Another problem that relates to the driving of mandrels for hard roll rewinding is an economic one. Heretofore it has been thought that high power was needed for driving the winding mandrel, so that a high torque could be applied to it for maintenance of the necessary web tension. On this premise, stringent footage and diameter specifications now being laid down for hard-wound rolls would require use of very large motors for mandrel driving. Such motors, in addition to being expensive in themselves, would have a high energy consumption, and production of very compact hard-wound rolls would become undesirably expensive. Furthermore, with a powerful motor driving the winding mandrel, the high torque imposed upon the mandrel would have to be transmitted to the web through the core, and an adequately slipless connection between the mandrel and the core could result in deformation of the latter.

Maintaining a required count or footage on each individual roll is a problem that is encountered with the winding of an untensioned web but is probably more severe with hard roll winding because of the need for also maintaining a closely specified diameter for the roll. Hence it is especially desirable to provide for quick and easy minor adjustments to the count or footage when hard-wound rolls are being produced. With prior automatic web rewinding apparatus, adjustability of the count was difficult and expensive because all phases of the cycle of loading of cores, core preparation, winding, and unloading were interdependent and were timed in relation to one another and to the rotation of the bed roll by a system of gears, sprockets or the like. Any change in the count required an expensive and time consuming change in the synchronizing gear system. Obviously, if it is found desirable to make a one-turn increase in the number of bed roll rotations for a finished individual roll—for example, to compensate for unusually "stretchy" web stock—it is undesirable to effect such change at the cost of providing the machine with a whole new gear system.

SUMMARY OF THE INVENTION

It is the general object of the present invention to provide a high-speed automatic web rewinding machine that is capable of successful production of hard-wound rolls which meet stringent requirements as to diameter and footage or count.

A specific object of the invention is to provide a high speed automatic web rewinding machine which is capable of winding under high web tension to produce hard-wound individual rolls, but which requires substantially smaller mandrel drive motors than would have been expected on the basis of prior technology and correspondingly consumes substantially less energy for winding.

Another specific object of the invention is to provide automatic high-speed web rewinding apparatus that is readily adjustable to provide for changing the web footage or count wound onto each finished roll.

Since capability for winding a web under substantially high tension is of the essence of the general object of this invention, it is another and more specific object of the invention to provide efficient means in automatic web rewinding apparatus whereby a web that is under substantial lengthwise tension can be cut through to terminate winding thereof onto one core and can be transferred to a new core to be wound onto the latter, all without losing control of the web and while the web continues to be advanced at a substantially high linear speed.

A further specific object of this invention is to provide an automatic web rewinding machine of the type comprising a plurality of rotatable mandrels that are circumferentially spaced around an indexingly rotatable turret to be carried thereby to each in turn of a succession of fixed stations, wherein each mandrel is brought up to a predetermined rotational speed during a period of dwell at an acceleration station, is rotatably driven at the next (winding) station by the application to it of such torque as will maintain a predetermined tension in the web, and is decelerated at the station after the winding station; and wherein two mandrels are usually being driven simultaneously but in respectively different modes of drive.

In connection with the last stated specific object of the invention it is a further specific object thereof to provide relatively simple and inexpensive means for effecting the proper mode of drive of each mandrel at the proper time and independently of the driving of all other mandrels.

Although the production of hard-wound rolls is a primary objective towards which the invention is directed, it is to be borne in mind that the production of hard-wound rolls poses a number of rather difficult problems which are not encountered with other types of automatic web rewinding, whereas such other web rewinding procedures pose no especially difficult problems that are not encountered in hard roll winding. Accordingly, it can be seen that another and rather general object of the present invention is to provide versatile automatic high-speed web rewinding apparatus that can be used for programmed winding by which soft rolls are produced as well as for production of very compact hard-wound rolls.

The several objects of the invention are achieved with web rewinding apparatus which comprises a plurality of mandrels that are moveable in succession along a defined path and each of which can support a tubular core for web winding rotation, a bed roll which rotates in one direction about a fixed axis adjacent to said path and around which a web has wrapping engagement as it moves towards a core on one of said mandrels to be wound thereonto, a cutoff roll adjacent to said bed roll and constrained to rotate oppositely to the bed roll in synchronism therewith, a knife carried by one of said rolls for cutting through the web to terminate winding thereof around one of the mandrels and produce a free leading portion on the web that can be attached to a new core on the next successive mandrel for winding thereonto, pins carried by the bed roll upon which the leading portion of the web is impaled at substantially the same time that the web is cut through, and transfer pad means carried by the bed roll for substantially radial extending and retracting motion whereby the leading portion of the web is disengaged from the pins and forced into engagement with said new core.

The web rewinding apparatus of the present invention is characterized by the following features which individually and in combination enable it to maintain control over the free leading portion of a web at the time the web is cut through and transferred to a new core, notwithstanding that the web is under substantial tension:

The knife is carried by the cutoff roll for extending and retracting motion relative thereto and is receivable, when extended, in an opening in the bed roll.

The pins are fixed on the bed roll in said opening therein.

Substantially blunt web impalement pusher means is carried by the cutoff roll for extending and retracting motion relative thereto, substantially in unison with extending and retracting motion of the knife, whereby the leading portion of the web is forced radially inwardly relative to the bed roll and into impalement upon said pins at substantially the same time that the web is cut through by the knife.

The transfer pads are finger-like and are elongated circumferentially of the bed roll. They are carried by actuating means on the bed roll so arranged that, relative to the bed roll, the transfer pads have a component of circumferential forward motion in the direction of bed roll rotation during their motion to their extended position whereby front end portions of the transfer pads are carried forwardly between the pins from a rearwardly spaced relationship to the pins. Preferably said actuating means comprises a rock shaft that has its pivot axis parallel to the axis of the bed roll and inwardly adjacent to the bed roll periphery, and said rock shaft is spaced circumferentially a substantial distance forwardly of the transfer pads and preferably also forwardly of the pins.

Another novel feature of the web rewinding apparatus of the present invention is that the web is constrained to advance towards the mandrel onto which it is being wound at a predetermined speed which is equal to the peripheral speed of the bed roll, and during winding a torque is applied to that mandrel which is controlled to maintain the web under a predetermined tension; and meanwhile a rider roll which is mounted for bodily movement towards and from that mandrel, and which is yieldingly biased towards that mandrel to exert radially inward force upon the web stock being wound around it, is driven in the direction opposite to that in which said mandrel rotates and at a peripheral speed which is higher than the speed of advance of the web, so that the rider roll, by its frictional engagement with the web stock wound around said mandrel, tends to increase the rotational speed of said mandrel and the tension in the web stock moving towards it.

The web winding apparatus of this invention comprises a turret on which a plurality of rotatable mandrels are spaced at uniform circumferential intervals and which revolves indexingly to carry each mandrel in turn to each of a succession of fixed stations, one of which is an acceleration station whereat the mandrel is brought up to a predetermined rotational speed and the next of which is a winding station whereat a controlled torque is applied to the mandrel for winding a web onto it under tension. To enable the torque developed by a motor at a location that is fixed with respect to said stations to be imposed upon one mandrel when it is at said winding station, the apparatus of this invention is characterized by a driver rotatably mounted on the turret, adjacent to said mandrel and in spaced relation to the turret axis; a clutch on the turret engageable to provide a rotation transmitting connection between said driver and said mandrel, said clutch being normally disengaged so that the driver can rotate freely relative to the mandrel; clutch actuating means on the turret, operatively associated with said clutch and cooperable with clutch control means fixed with respect to said stations to engage the clutch as said mandrel approaches the winding station and to maintain the clutch engaged while the mandrel remains at the winding station; a torque transmitting element rotatable concentrically to the turret axis; first substantially slipless torque transmitting means drivingly connecting the motor with said torque transmitting element, and second substantially slipless torque transmitting means drivingly connecting the torque transmitting element with the driver.

Preferably the turret has an even number of mandrels thereon, comprising odd-numbered mandrels alternating with even-numbered mandrels circumferentially around the turret, and there are two motors, one for the odd-numbered mandrels, the other for the even numbered ones. There is a driver for each mandrel and a clutch for each mandrel, all carried by the turret, each clutch being engageable to connect the driver for its mandrel with its mandrel. Transmission means are so arranged that each of the motors is at all times drivingly connected with the drivers for its mandrels, and each clutch is engaged as its mandrel is carried into an acceleration station that precedes the winding station and is disengaged during movement of its mandrel away from the winding station.

To provide for relief of web tension during the first few turns of a mandrel after the web has been attached to a core carried by the mandrel, the mandrel rotates in the direction opposite to that of bed roll rotation, whereas the turret rotates in the same direction as the bed roll, so that as the mandrel is carried towards the winding station by the turret, immediately after web transfer, the mandrel is carried in the direction opposite to that of advance of the web.

To provide for adjustment of the amount of web wound onto each core, the web winding apparatus of this invention is characterized by resettable counter means operatively connected with the bed roll to store a magnitude corresponding to the number of revolutions made by the bed roll next following each resetting of the counter means, said counter means being arranged to issue an output when said magnitude attains an invariable value. Adjustable resetting means is connected with the counter means for resetting the same to a zero value of said magnitude when said magnitude attains a selected one of a plurality of different values higher than said invariable value. For driving an indexing mechanism that effects advancing movements of the turret whereby mandrels are carried from station to station there is a drive member which is constrained to move at a speed having a fixed relationship to the speed of bed roll rotation; and a clutch that is connected with said counter means to receive said output from the counter means drivingly connects the drive member with the indexing mechanism upon receipt of the output.

BRIEF DESCRIPTION OF DRAWINGS

In the accompanying drawings, which illustrate what is now regarded as a preferred embodiment of the invention:

FIG. 14 is a fragmentary view in elevation of the bed roll, showing the portion thereof that is involved in web cut-through and transfer;

FIG. 19 (on sheet 11) is a diagrammatic view illustrating the principles of the mechanism for adjustably controlling the length of web stock that is wound onto a roll with the mechanism of this invention.

DETAILED DESCRIPTION OF PREFERRED EMBODIMENT OF THE INVENTION

Figure 1:
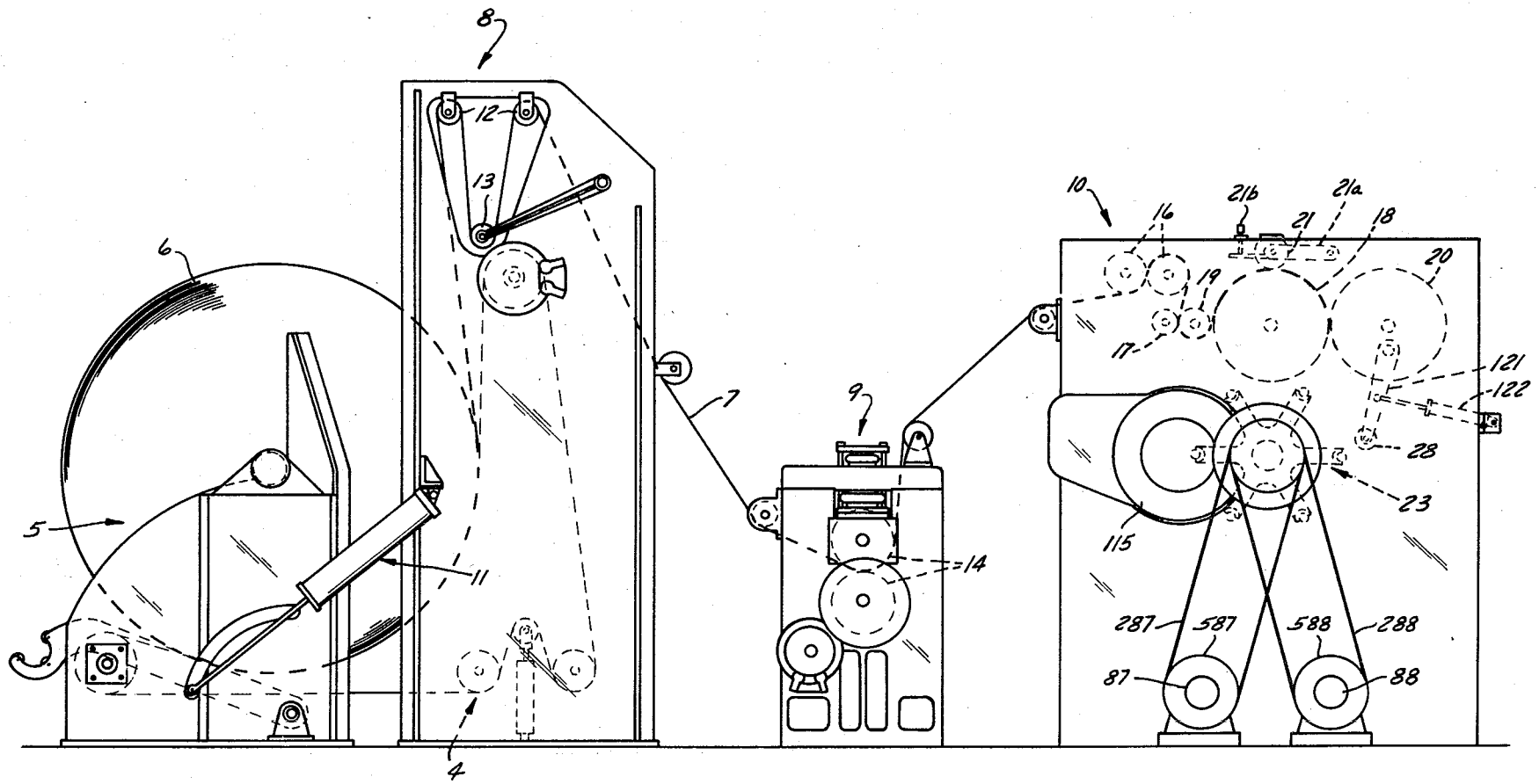
FIG. 1 is a more or less diagrammatic view in elevation of a complete web rewinding installation comprising apparatus embodying the principles of this invention.

Referring now to the accompanying drawings, apparatus for web rewinding conventionally comprises (FIG. 1) a parent roll stand 5 on which a parent roll 6 is supported for rotation with its axis horizontal so that a web 7 can be drawn off of it. The parent roll is rotated by a conventional driving belt 4 which engages its periphery. The web 7 passes successively through a tensioning station 8 and an embossing station 9, to rewinding apparatus 10 that embodies the principles of this invention, where the web 7 is wound onto individual cores as explained hereinafter.

The generally conventional parent roll stand 5 comprises mechanism 11 for lifting a parent roll 6 into place on the stand, and can also comprise suitable means (not shown) for web splicing. The tensioning station 8, which is also generally conventional, is here shown more or less schematically as comprising three rollers around which the web 7 zig-zags, two of said rollers, designated by 12, being rotatable on fixed axes and the third roller 13 being a dancer which cooperates with the fixed rollers 12 to take up varying amounts of slack in the web so that the parent roll 6 can rotate at a substantially fixed rate notwithstanding variations in the rate of advance of downstream portions of the web. At the embossing station 9 the web 7 may pass between embossing rollers 14 by which it is embossed with a waffle-grid or similar pattern that stretches its fibres to increase its absorbency in a known manner. Obviously the embossing station can be omitted, or the web can be caused to by-pass the embossing rollers 14.

In the following explanation it will be assumed that the web 7 is to be rewound under tension to produce hardwound individual rolls, although it will be understood that the apparatus of this invention lends itself to the production of individual rolls that are not hardwound. The apparatus would seem to be well suited for rewinding two-ply and multi-ply webs if it is combined with suitable known apparatus for causing adhesion between the plies of such materials.

If the web 7 has been passed through the embossing rollers 14 and is to be formed into hard wound rolls, then it is preferably passed through calendaring or debossing rolls 16 as it enters the rewinding apparatus 10. The web 7 also passes slitters 17 which cooperate with a slitter roll 19 to slit the web lengthwise and thus reduce it to the widths desired for the finished individual rolls. Since the calendaring and web slitting apparatus; like the embossing rollers, is generally conventional, it is illustrated only rather schematically in its relationship to a bed roll 18 that comprises an essential element of the rewinding apparatus. It will be understood that the web 7 may also pass in engagement with a perforator roll (not shown) in the course of its forward movement from the parent roll 6 to the bed roll 18.

Rewinding Apparatus—General Arrangement

As explained in detail hereinafter, the web 7 passes directly from the bed roll 18 to a core 24 upon which it is being wound. Because the web is wound under tension, the bed roll 18 comprises means for constraining the web 7 to advance at a substantially constant predetermined speed, while winding takes place in such a manner as to tend to draw the web past the bed roll at a faster speed.

To prevent slippage between the web 7 and the bed roll 18, the web has substantial wrapping engagement with the bed roll; that is, the web is in contact with the bed roll around approximately three-fourths of its periphery. The web is guided into engagement with the bed roll 18 at a slitter roll 19 which is adjacent to both the web slitters 17 and the bed roll 18 and around which the web likewise has substantial wrap.

To further confine the web 7 against slippage relative to the bed roll 18, there is a nip roll 21 (best seen in FIGS. 2 and 3) which cooperates with the bed roll and under which the web passes at a medial point in its wrap around the bed roll. The nip roll 21 is preferably a felt roll, so that is has good frictional engagement with the web, and it is driven to have a peripheral speed which matches that of the bed roll 18. Furthermore, the nip roll 21 is supported on a carrier 21*a* which mounts it for bodily motion toward and from the bed roll axis and which is controlled by manually adjustable spring biasing means 21*b* that causes the nip roll 21 to exert a substantial clamping force upon the web 7 whereby the web is urged strongly against the bed roll 18. The adjustable biasing arrangement 21*a*, 21*b* for the nip roll 21 is of a generally conventional type and therefore is not shown in detail.

Also adjacent to the bed roll 18 is a cutoff roll 20 which rotates about a fixed axis, in synchronism with the bed roll and in the direction opposite to that of bed roll rotation. The web 7 passes the cutoff roll 20 after it has passed under the nip roll 21 and shortly before it passes out of engagement with the bed roll 18. During most of a winding operation the web has no contact with the cutoff roll 20, but at the time the web is to be transferred from one core 24 to another, mechanism on the cutoff roll 20 cooperates with mechanism on the bed roll 18 to cut through the web and effect the transfer, as explained hereinafter.

As is generally conventional, the tubular cores 24 onto which the web 7 is wound are supported on rotatable mandrels 22 carried by an indexingly rotatable turret 23. There are six mandrels 22 on the turret 23. Their axes are parallel to the rotational axis of the turret, and they are spaced at like distances from the axis about which the turret 23 rotates and at uniform distances from one another. At each indexing motion of the turret 23 it is rotated through one-sixth of a revolution, and therefore each mandrel 22, in the course of a complete orbit, is carried successively through six fixed stations, at each of which it dwells for a uniform interval determined by the time needed for complete winding of an individual roll.

The first of these stations, designated by A (FIG. 3), is a loading station at which a length of tubular core stock 24 is loaded axially onto the mandrel 22 and is releasably chucked to it to be constrained to rotate with the mandrel. The mechanism of the loading station A can be generally conventional and therefore it is not shown in detail.

Figure 2:
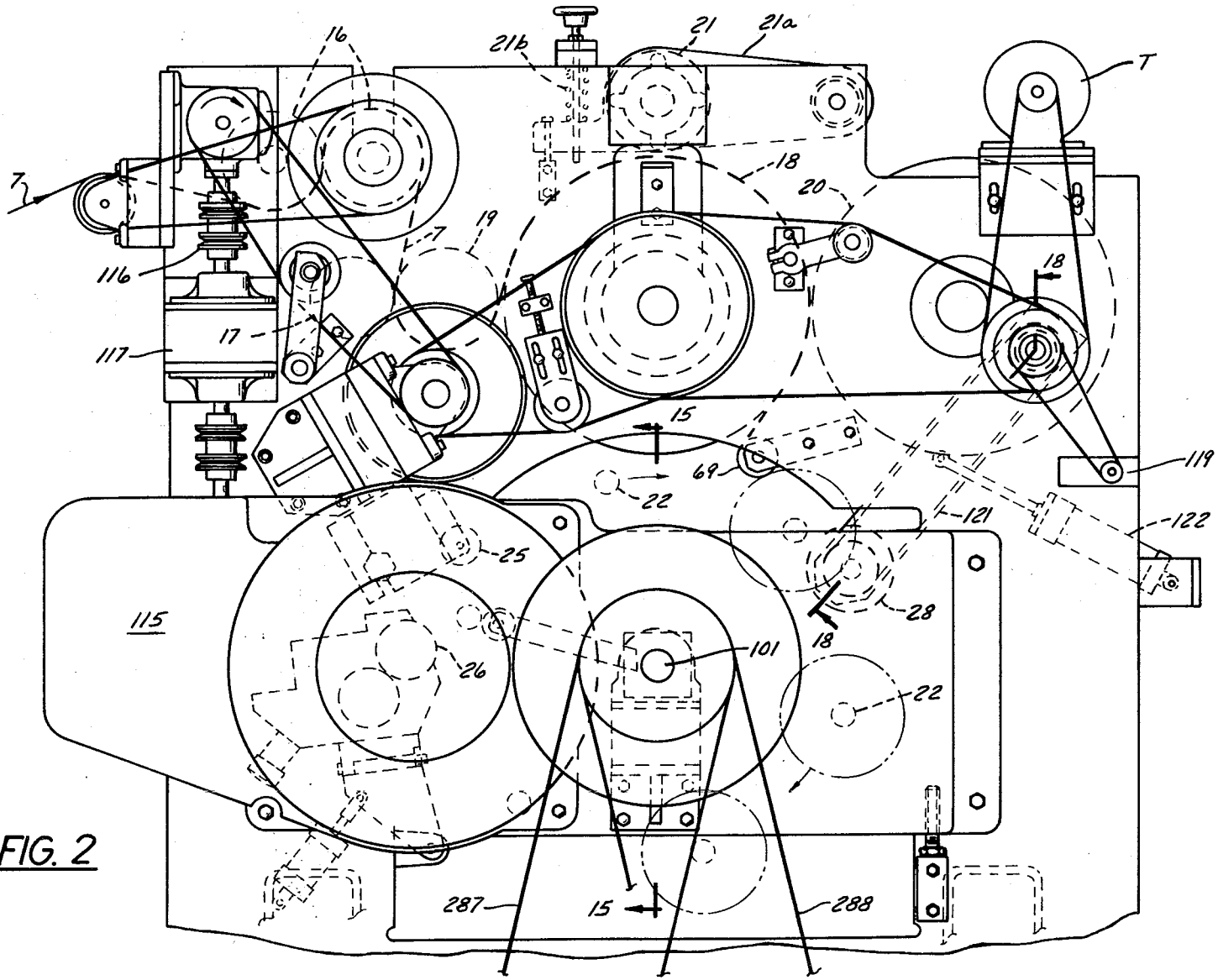
FIG. 2 is a view in elevation of the web rewinding machine of this invention, as seen from the side thereof at which the rolls are driven.
Figure 3:
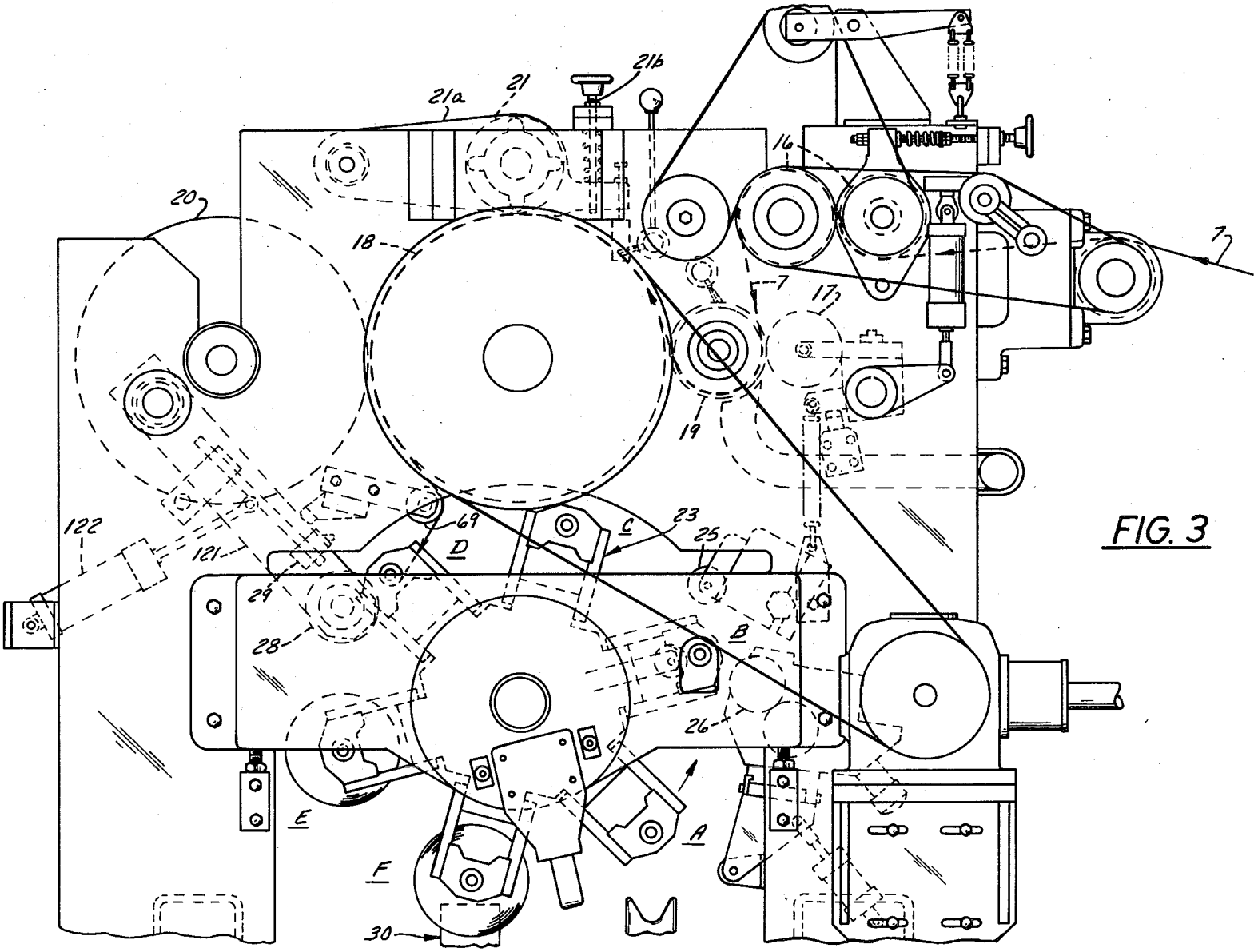
FIG. 3 is a view in elevation generally similar to FIG. 2 but taken from the opposide side of the machine.

The first indexing motion after loading carries the mandrel to a gluing and core slitting station B. When loaded onto the mandrel, the core stock 24 normally has an unbroken length that is equal to the width of the web 7. At the gluing and core slitting station B the core stock 24 is cut into shorter lengths, corresponding to the width desired for the finished individual rolls. Such cutting is accomplished by rotating the mandrel, with the core stock thereon, in contact with a core slitter roll 25. While this core slitting is taking place, the core 24 is also being contacted by a glue applicator roll 26 that applies axially spaced circumferential stripes of adhesive to the core. The core slitting and gluing operations take place during a first portion of a period of dwell of a mandrel at the core slitting and gluing station B. During the remainder of the period of dwell, and during indexing motion, the core slitter roll 25 and the glue applicator roll 26 are in retracted positions, spaced from the mandrel 22, in which they are shown in FIGS. 2 and 3. The gluing and core slitting mechanisms can be generally conventional.

The next indexing movement carries the mandrel 22 to an acceleration station C at which, as more fully explained hereinafter, the mandrel is started in rotation and is brought up to a speed at which the peripheral speed of the core 24 on the mandrel substantially matches that of the bed roll 18 and thus substantially matches the linear speed of the web 7.

During the next indexing movement, in which the mandrel 22 is carried from the acceleration station C to a winding station D, the mandrel is carried through close proximity to the bed roll 18. As it is approaching the bed roll, a web transfer operation begins. The web 7 is cut through, to detach it from a core 24 that has just been wound at the winding station D. Such cutting through of the web, which occurs as the wound core is moving away from the winding station D, terminates winding upon that core. The cut thus made through the web defines a new free leading portion for the web that is temporarily secured to the bed roll 18 to be carried by the bed roll as it turns through a fraction of a revolution. Just as the new core arrives at its closest proximity to the bed roll 18 during its movement from the acceleration station C to the winding station D, this new leading portion of the web is released from the bed roll and is simultaneously engaged against the new core 24 for adhesion to the freshly applied glue thereon. As the mandrel 22 continues its orbital indexing movement into the winding station D, the mandrel rotation that began at the acceleration station C is of course continued, but during winding a controlled torque is applied to the mandrel to maintain the desired tension on the web. As further assurance that a hardwound roll will be produced, a rider roll 28 firmly engages against the roll being wound at the winding station D, to press air out from between its layers.

After a predetermined number of revolutions of the bed roll 18, the core 24 at the winding station D is fully wound. As it moves out of the winding station, a succeeding core is moving into that station and the web 7 is cut through as already explained.

Figure 5:
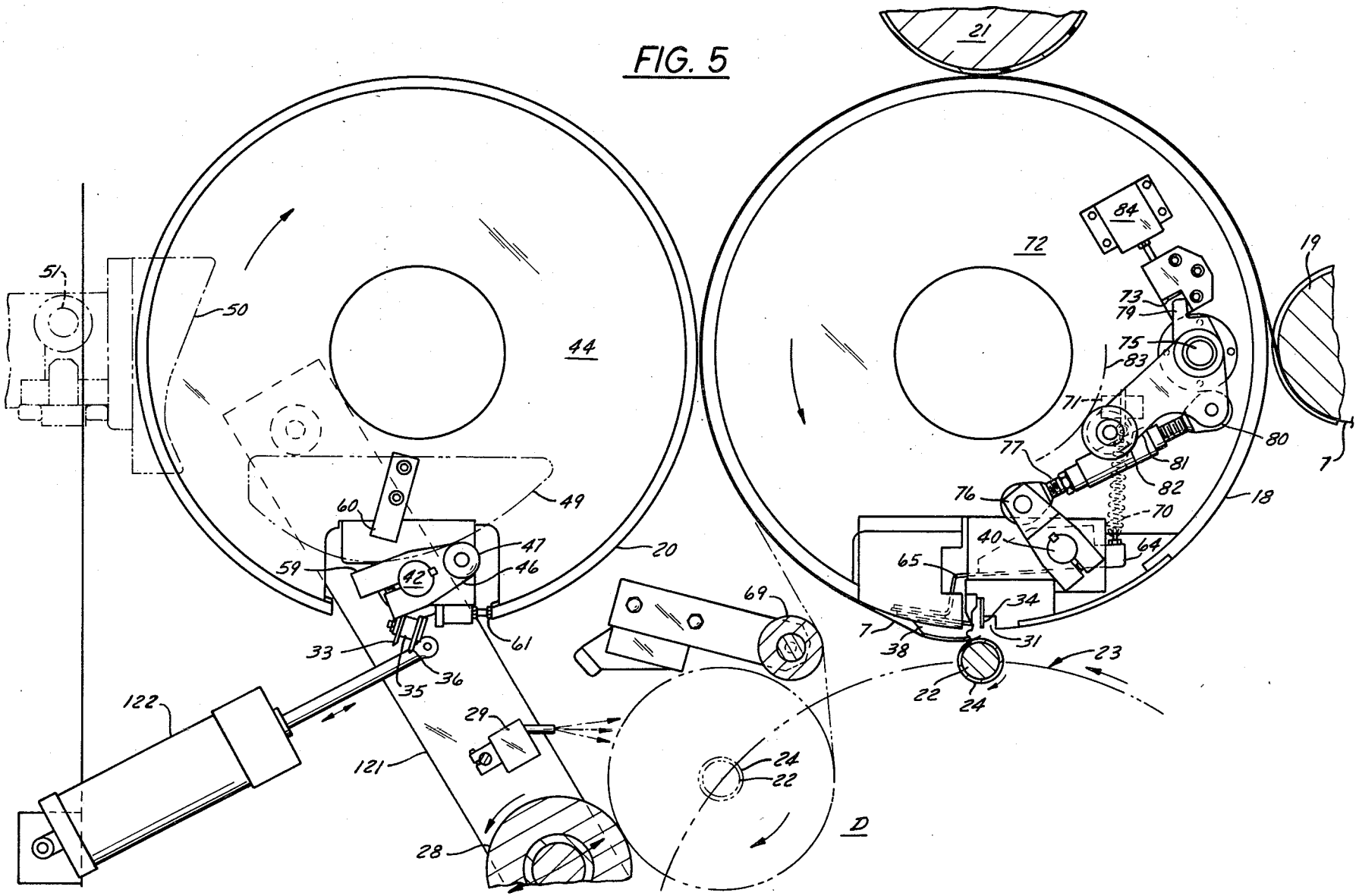
FIG. 5 is a view generally similar to FIG. 4 but showing conditions at the instant of transfer of the web to a new core.

As the fully wound roll begins to move out of the winding station D towards a deceleration station E, it has a loose tail, and a small amount of glue is sprayed at it from a glue sprayer 29 (FIGS. 3 and 5) to cause the tail to adhere lightly but securely to the body of the roll so that the roll will not unwind during subsequent handling. Glue spraying takes place before the wound roll passes out of contact with the rider roll 28, and continuing rotation of the wound roll enables the rider roll 28 to wipe the tail onto the body of the wound roll.

After a certain amount of motion of the mandrel 22 away from the winding station D, it is no longer rotatably driven, but its rotation continues due to inertia. At the deceleration station E its rotation is brought to a stop, as explained hereinafter.

The last indexing movement in the turret cycle carries the mandrel 22 from the deceleration station E to an unloading station F at which the wound cores are stripped axially off of the mandrel. The mandrel unloading mechanism—which can be generally conventional—is seen in part in FIG. 15, where it is designated by 30.

Another indexing motion then brings the unloaded mandrel 22 back to the loading station A for a repetition of the cycle.

Mechanism for Web Cutoff and Transfer

The description now proceeds with particular reference to FIGS. 4–10.

In the apparatus of the present invention, the bed roll 18 has a lengthwise extending slot 31 in its periphery, and in that slot the bed roll carries a row of fixed pins 32, spaced along the length of the slot. When the web 7 is cut through to terminate winding on one core 24 and to transfer winding to a new one, the free leading portion of the web is impaled upon the pins 32.

The knife 33 that cuts through the web is carried by the cutoff roll 20, to move orbitally with cutoff roll rotation and to be movable relative to the cutoff roll in substantially radial extension and retraction. While winding onto a core is taking place, the knife 33 remains retracted and lies within the peripheral limits of the cutoff roll 20 so that it does not come into contact with the web 7 as its orbital motion carries it through proximity to the bed roll 18. When the web is to be cut through, the knife 33 is actuated to its extended position, in which it projects radially beyond the periphery of the cutoff roll 20. The rotation of the cutoff roll 20 is synchronized with that of the bed roll 18 (as by a gear connection between them) so that the extended knife 33 penetrates through the web 7 and into the slot 31 in the bed roll. Taking the direction of bed roll rotation and of web travel as forward, the knife 33 enters the slot 31 a small distance behind the front edge of that slot and a small distance ahead of a blunt cutting bar 34 that is fixed on the bed roll within the slot 31. The cutting bar 34 extends along substantially the full length of the bed roll, a short distance ahead of the pins 32. It will be seen that the portion of the web that is engaged by the knife 33 constitutes a short span that extends between the cutting bar 34 and the front edge of the slot 31; and because of the tension of the web and the short length of this span, the knife 33 cuts quickly and cleanly through the web.

A carrier element 35 on the cutoff roll 20 that supports the knife 33 for its extension and retraction also supports a web impalement pusher bar 36 for substantially radial extension and retraction in unison with the knife. Like the knife 33, the web impalement bar 36 extends along substantially the full length of the cutoff roll. As the knife 33 is cutting through the web 7, the extended web impalement bar 36 is urging the resultant leading portion of the web radially inwardly relative to the bed roll 18, to impale the web on the pins 32. Slots 37 at intervals along the length of the web impalement bar 36 accommodate the respective pins 32, enabling the web impalement bar to enter the slot 31 in the bed roll and drive the web a substantial and definitely established distance onto the pointed end portions of the pins.

Mounted on the bed roll 18 to be carried orbitally by its rotation and for unison substantially radial extending and retracting movement relative to it are a set of web transfer pushers or pressure pads 38, each comprising a finger-like member of resilient material (e.g., soft rubber or urethane) which has its length extending circumferentially, in the direction of bed roll rotation. The pads or pushers 38 have their front ends adjacent to the pins 32, and they are spaced from one another along the length of the bed roll. The pushers 38 extend and retract through circumferentially elongated slots **38*a* in the bed roll periphery that open at their forward ends to the axially extending slot 31 in the bed roll, as best seen in FIG. 14. When the web transfer pushers 38 are in their retracted positions (FIGS. 4, 7, 8) a radially outermost surface 39 on each lies radially inwardly of the bed roll periphery; and when the pushers 38 are extended (FIGS. 5 and 9) said surface 39** is spaced radially outwardly of the bed roll periphery all along its length.

When rotation of the bed roll 18 has carried the pins 32, with the web impaled thereon, to a position opposite the new core 24 to which the web is to be transferred, the web transfer pushers 38 are extended. As explained hereinafter, extension of the pushers 38 is rather rapid but not abrupt, and they attain their fully extended position at substantially the instant when the pins 32 are nearest the new core. In fact, the timing of full extension of the pushers 38 is not extremely critical; it can occur very slightly before the point at which the pins 32 are closest to the new core, or up to several degrees of bed roll rotation after that point. The reason for this leeway in the timing of full extension of the pushers 38 is that they are so arranged that they can immediately and firmly engage the web against the new core 24 practically instantaneously after they effect a positive detachment of the web from the pins 32, provided only that the bed roll 18 is within the range of rotational positions just mentioned at the time such transfer is to take place.

Figure 8:
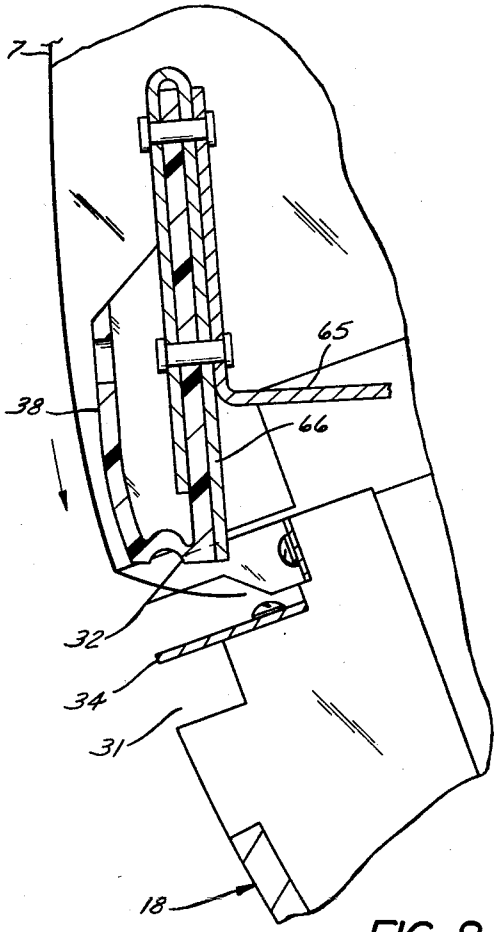
FIG. 8 is a fragmentary view in vertical section through the bed roll at a time between the instant of web cut-through and the instant of web transfer.

Specifically, for their extending and retracting motion the pushers 38 swing about a rock shaft 40 that is carried by the bed roll 18 at a location near its periphery—but spaced radially inwardly therefrom—and spaced a substantial distance forward of the pushers themselves, taking the direction of bed roll rotation as forward. Because of this location of the axis about which they swing, the extending motion of the pushers 38 carries them in a circumferentially forward as well as a radially outward direction relative to the pins 32. The circumferentially forward component of their extending motion carries their front end portions between the pins 32 so that the radially outward component of force that they exert upon the impaled web is substantially lengthwise in line with the pins to ensure quick and positive detachment of the web from them. Furthermore, when the pushers 38 are extended, the radially outer surface of each is so oriented (see FIGS. 5 and 9) that almost any point along its length can make clamping engagement with the new core 24, which is to say that the pushers 38 can exert web-engaging force against a core through a substantial number of degrees of rotation of the bed roll 18. In fact, as will be evident from a consideration of FIG. 9, if the pushers 38 are extended after the pins 32 have passed the new core, it is possible for the web to be engaged against the new core slightly before it is disengaged from the pins. The cutting reaction bar 34 on the bed roll 18, which cooperates with the knife 33, is located only a small distance ahead of the pins 32, and, in turn, the knife engages the web only a small distance ahead of the reaction bar. Hence the knife cut is made at a rather small distance forward of the pins 32, and the length of free leading web portion that extends ahead of the pins is somewhat further reduced by the tension on the web, by which it is drawn backward from the bar 34. This is to say that (as FIG. 8 shows) the length of free web that projects forward of the pins 32 is not much more than just enough to prevent the pins from tearing through the newly-cut edge of the web. Furthermore, this free leading portion of the web tends to extend radially inwardly relative to the bed roll, owing to the manner in which the knife 33 and the web impalement pusher bar 36 have acted upon it, so that the forward component of motion of the web transfer pushers 38 during their extension causes them to have a cam-like wiping action on the web that further contributes to definite and positive disengagement of the web from the pins 32.

Actuating Mechanism for Knife and Web Impalement Pusher Bar

Figures 4, 13:
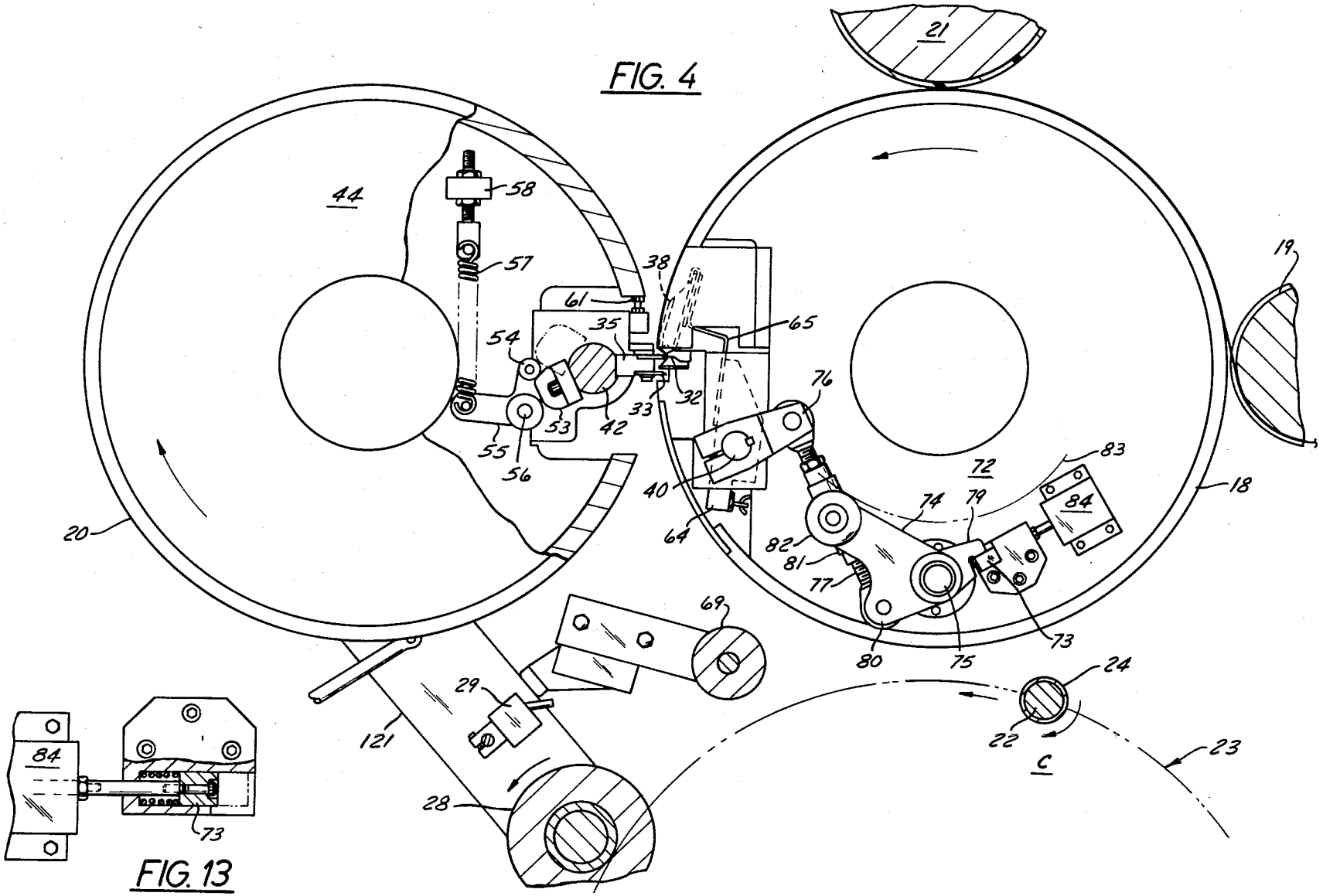
FIG. 4 is an enlarged view, mainly in vertical section, through the bed roll and cutoff roll and their associated mechanisms and adjacent portions of the machine, in the conditions that exist at the instant of cutting through and impalement of the web.
FIG. 13 (on sheet 4) is a fragmentary view, partly in section, of a detail of the solenoid actuated latch mechanism on the bed roll.
Figure 6:
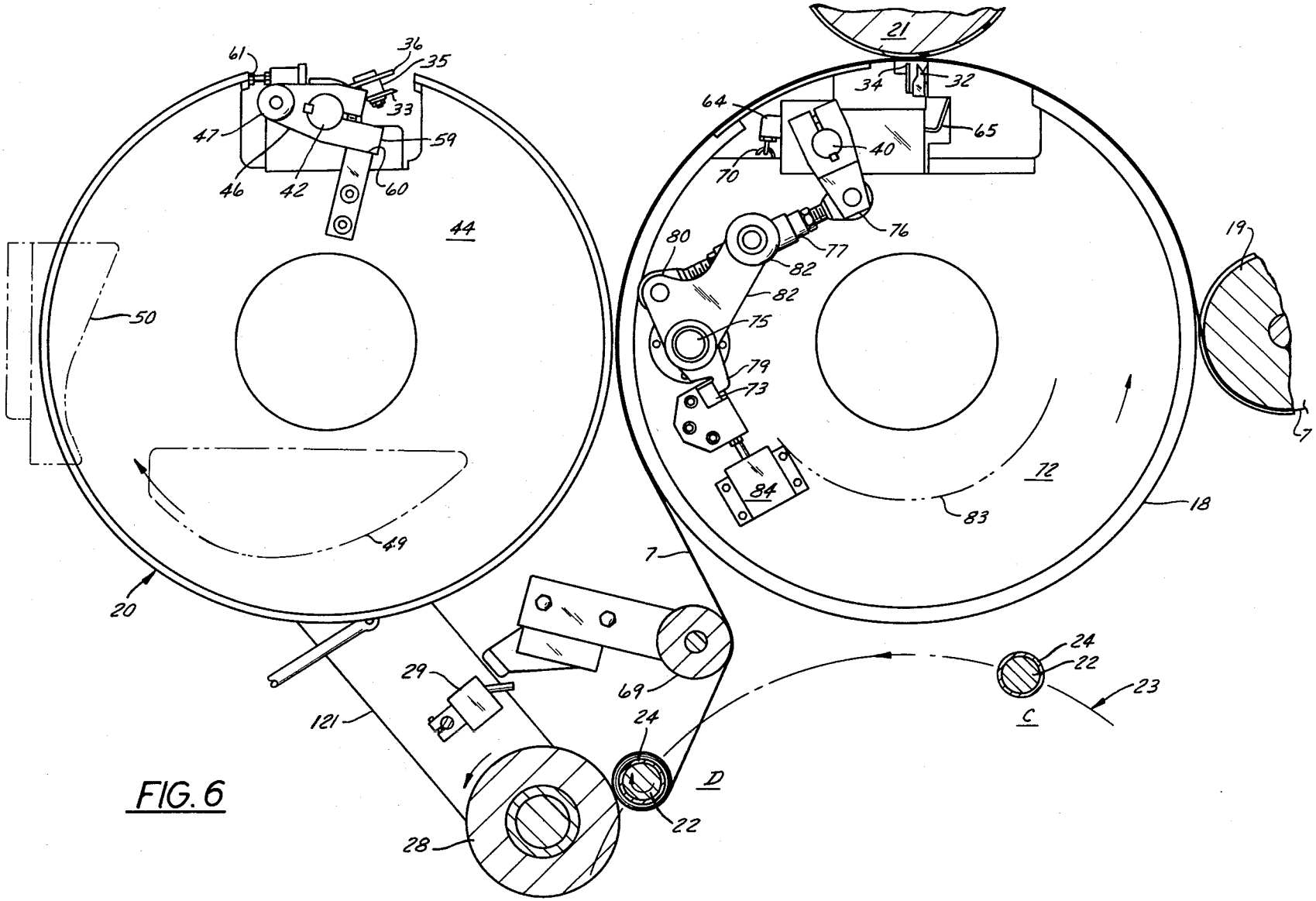
FIG. 6 is a view generally similar to FIGS. 4 and 5 but showing the conditions that exist through most of the time that winding is taking place.
Figure 7:
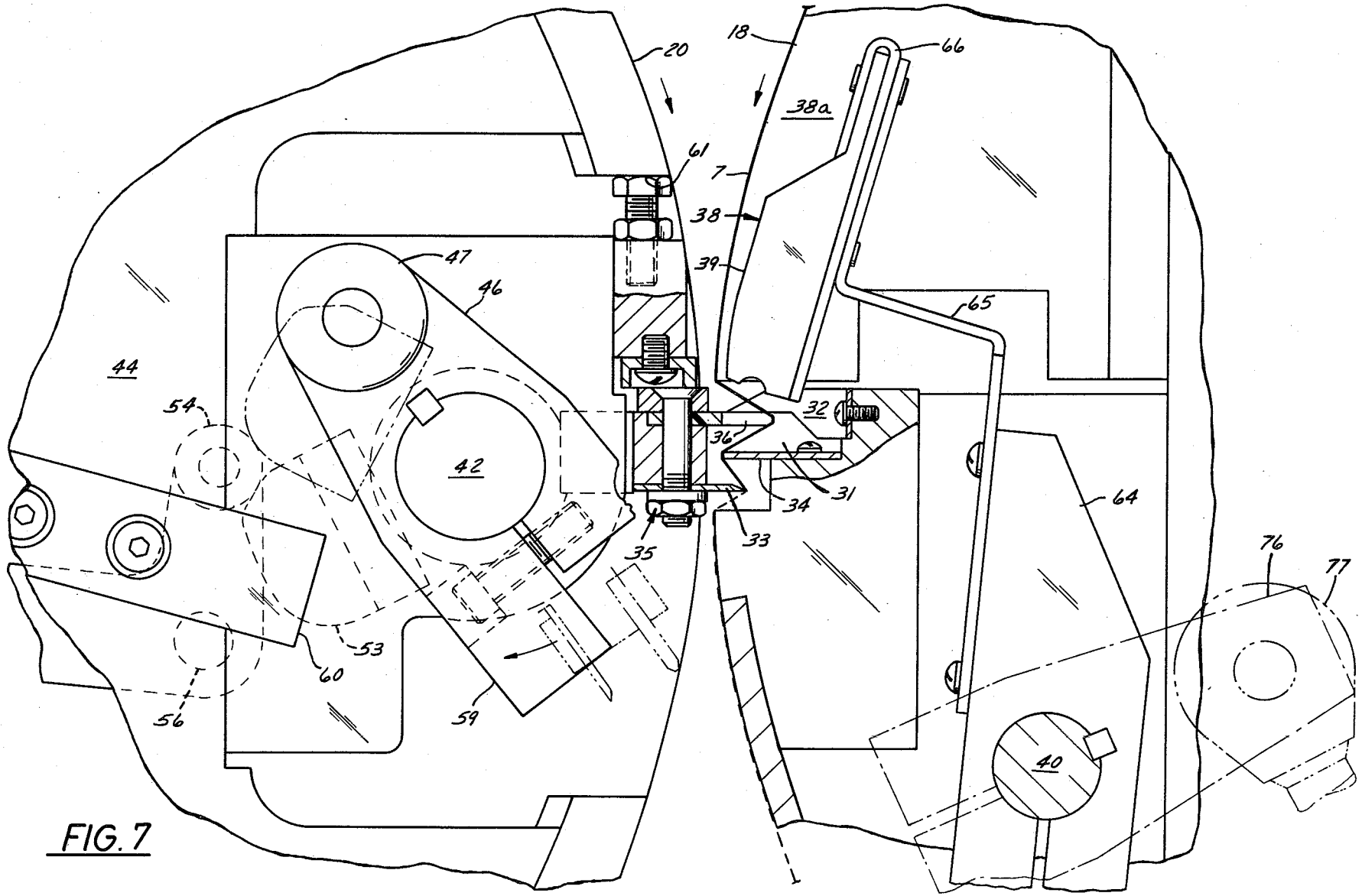
FIG. 7 is a further enlarged fragmentary view of the bed roll and cutoff roll, partly in elevation but mainly in vertical section, showing those rolls in their conditions at cut-through and impalement of the web.
Figure 9:
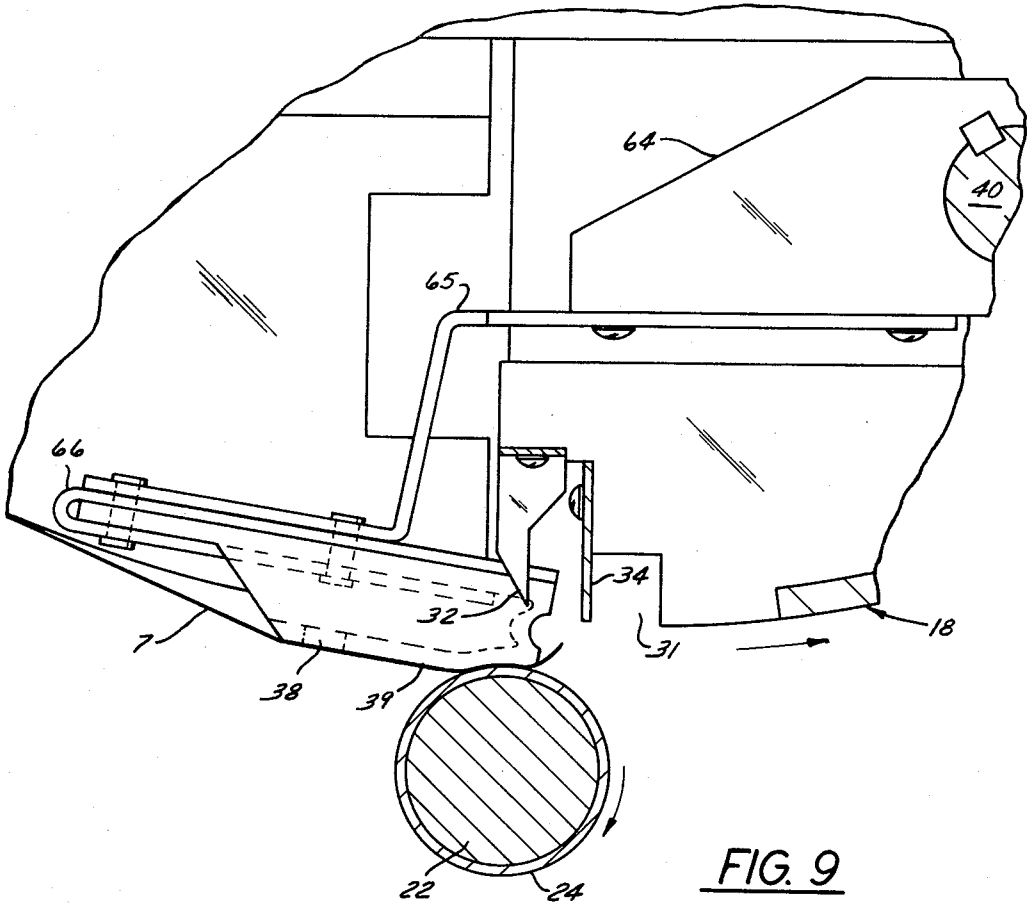
FIG. 9 is a view generally similar to FIG. 8 but showing the bed roll in relation to a core on which web is to be wound, and at the instant of transfer of the web to that core.
Figure 10:
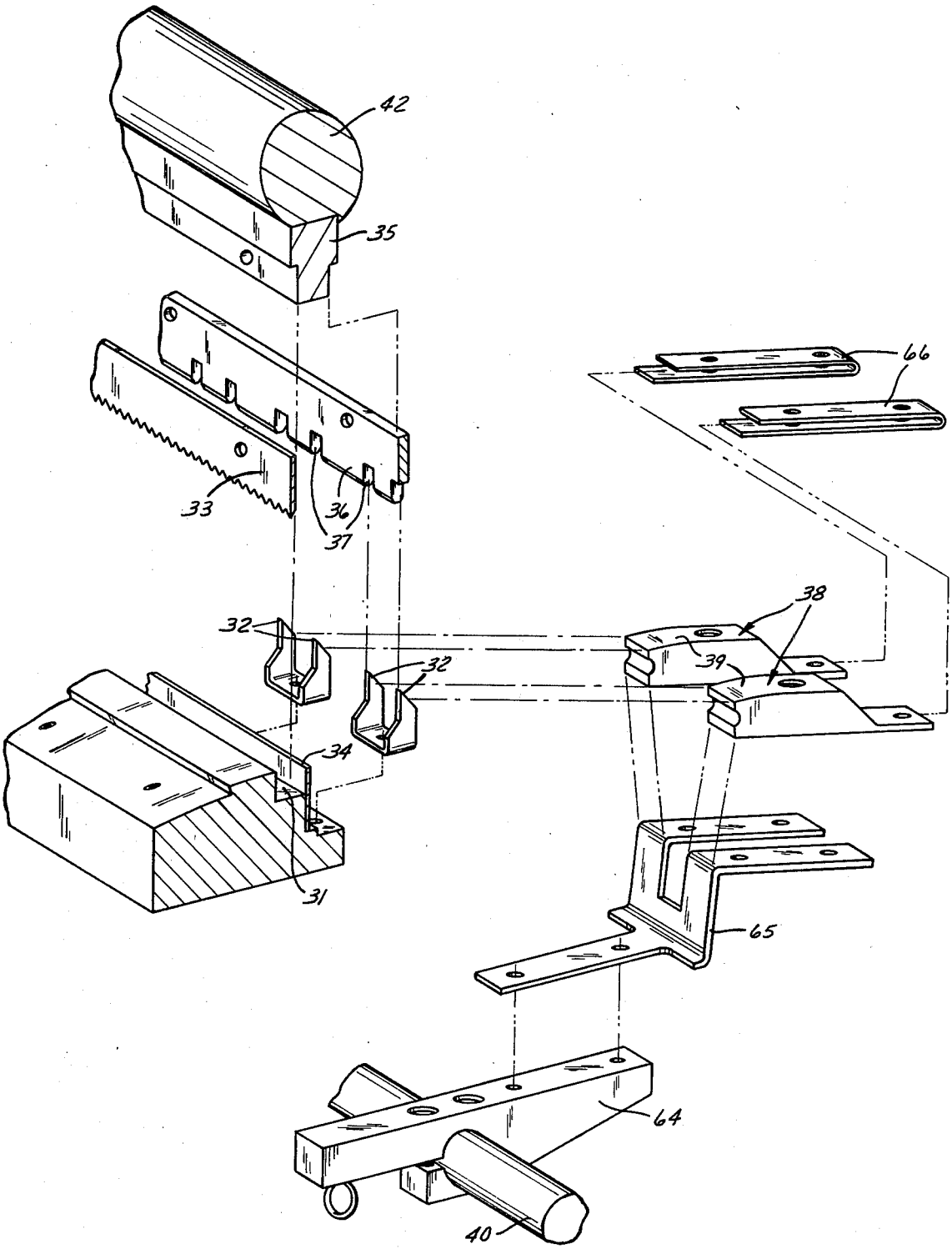
FIG. 10 is a fragmentary exploded perspective view of the retractable and extendable elements of the bed roll and cutoff roll shown in their relation to the pins that are fixed in the cutoff roll.
Figure 12:
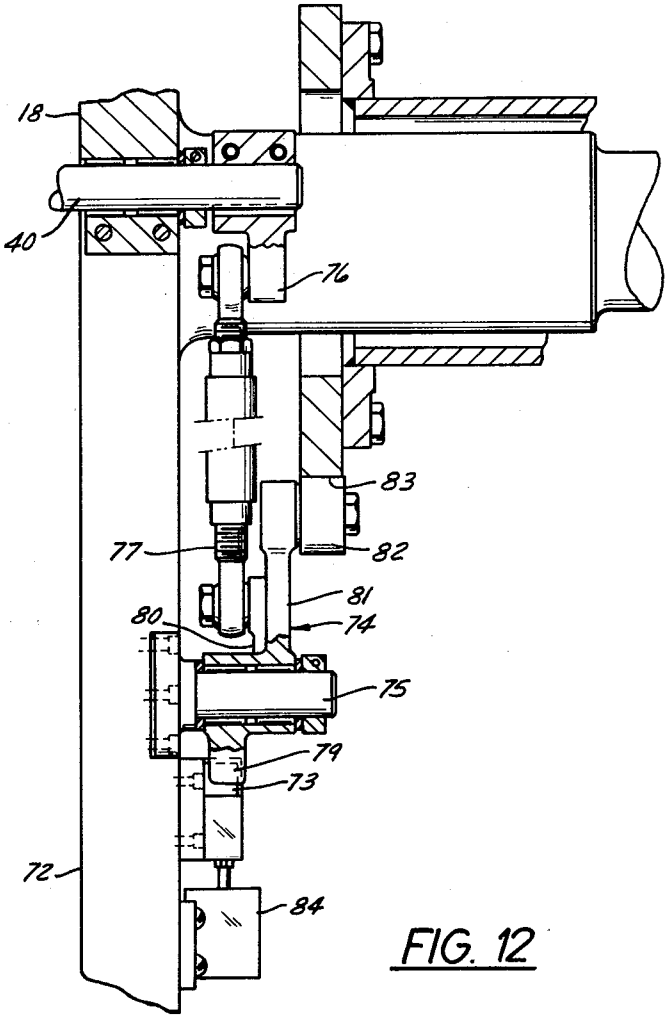
FIG. 12 is a fragmentary view in vertical section through the bed roll, near one end thereof, showing the actuating mechanism for the web transfer pushers or pads.

As best seen in FIG. 10, the knife 33 and the web impalement pusher bar 36 comprise strip-like elements which are fastened to opposite sides of a carrier bar 35. The carrier bar 35, in turn, extends along a rock shaft 42 and projects laterally from one side thereof. End portions of the rock shaft 42 are received in coaxial bearings 43 mounted in the end walls 44 of the cutoff roll 20, so that the rock shaft 42 can pivot about an axis which is near the periphery of the cutoff roll and parallel to the axis about which the cutoff roll rotates. Rotation of the rock shaft 42 through a partial turn in one direction thus carries the knife 33 and the web impalement pusher bar 36, as a unit, from the retracted position in which they are shown in FIG. 6 to the extended, radially outwardly projecting position in which they are shown in FIGS. 4 and 7. Rotation of the rock shaft in the opposite direction of course carries the knife 33 and the pusher bar 36, in unison, back to their retracted position.

Figure 11:
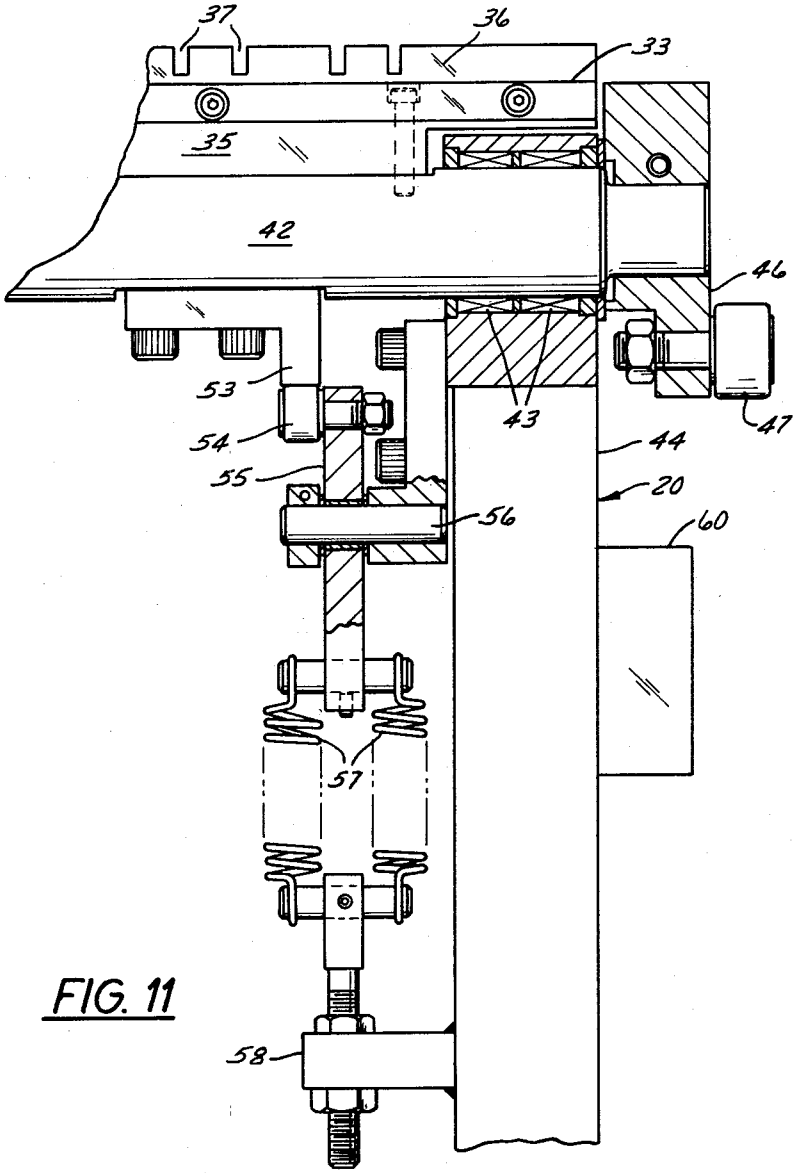
FIG. 11 is a fragmentary view in longitudinal section through the cutoff roll, taken near one end thereof, showing the actuating mechanism for the knife and the web impalement pusher bar.

The rock shaft 42 is swung to its retracted and extended positions of rotation by means of a cam and cam follower mechanism at each end of the cutoff roll 20 (FIG. 11). At the axially inner side of each of the cutoff roll end walls 44 are abutment means cooperating with overcenter detent means to define the respective positions to which the rock shaft 42 is swung by the cam mechanism.

Considering first the cam and cam follower means by which swinging motion is imparted to the rock shaft 42, it comprises (FIGS. 5, 6, 7, 11), at each end of the cutoff roll 20, an actuating arm 46 which is anchored to the rock shaft 42 and projects radially therefrom and a cam follower roller 47 which is carried on the outer end of said arm 46 and which is freely rotatable about an axis parallel to that of the rock shaft 42. Each actuating arm 46 is at the axially outer side of its adjacent end wall 44 of the cutoff roll, so that its roller 47 can cooperate with a fixed cam 49 and a moveable cam 50 that are mounted on the machine frame adjacent to the end of the cutoff roll.

Most of the time the movable cam 50 is spaced to one side of the orbit of the cam follower roller 47, but the movable cam is actuated by a solenoid 51 (FIG. 5) that is energized only during a revolution of the cutoff roll 20 in which web cutoff and transfer is to occur. Energization of the solenoid 51 causes the movable cam 50 to be shifted axially inwardly relative to the cutoff roll, to an operative position in which it is engaged by the cam follower roller 47. The movable cam 50 then cooperates with the roller 47 to swing the actuating arm 46 radially inwardly relative to the cutoff roll, thus rotating the rock shaft 42 to its knife-extended position. Thereafter, as the cutoff roll 20 continues its rotation, and after the knife 33 has cut through the web, the orbital motion of the cam follower roller 47 brings it into engagement with the fixed cam 49, by which it is driven radially outwardly relative to the cutoff roll to rotate the rock shaft 42 back to its knife-retracted position. The movable cam 50 occupies its extended position during only a part of a revolution of the cutoff roll, and therefore the knife 33 remains in its retracted position through a number of revolutions of the cutoff roll 20 and until very shortly before the next web transfer operation is to occur.

Because of the detent arrangement now to be described (FIGS. 4, 7, 11) the rock shaft 42 is held in the rotational position in which it was placed by the cam 49 or 50 that last actuated it. Secured to the rock shaft 42, inwardly adjacent to each end wall 44 of the cutoff roll, is a detent cam arm 53 which projects radially from the rock shaft 42 and which cooperates with a detent roller 54 that engages the detent cam arm 53 under a biasing force that is directed towards the axis of the rock shaft 42. To enable such biasing force to be imposed upon the detent roller 54, it is mounted on one arm of a bell crank 55 that is fulcrumed, as at 56, to swing across the inner surface of the cutoff roll end wall 44. To the other arm of the bell crank 55 is connected one end of a tension spring means 57 that has its other end anchored to a bracket 58 that is fixed on the cutoff roller end wall 44. As shown in FIG. 11, the tension spring means 57 can comprise a pair of coiled tension springs connected in parallel. As best seen in FIGS. 4 and 7, the cam surface on the detent cam arm 53, which is engaged by the detent roller 54, is so formed that rotation of the rock shaft 42 towards either of its defined positions forces the detent roller 54 away from the rock shaft axis, increasingly tensioning the spring means 57 until the hump of the detent cam passes the detent roller 54, whereupon the spring biased detent roller 54 so cooperates with the cam surface as to snap the rock shaft 42 the rest of the way to the position towards which it was moving.

The knife-retracted position of the rock shaft 42 is defined by engagement of an abutment surface 59 on the actuating arm 46 against an abutment member 60 that is fixed on the axially outer surface of the end wall 44 of the cutoff roll. The knife-extended position of the rock shaft 42 is defined by engagement of the knife carrier bar 35 against an adjustable abutment 61 that is mounted on the end wall 44 of the cutoff roll. Note that the spring means 57, acting through the detent roller 54, maintains the rock shaft 42 firmly in the position defined for it by each of the abutments 60 and 61.

Actuating Mechanism for Web Transfer Pads

The mechanism for extending and retracting the web transfer pushers or pressure pads 38 on the bed roll 18 can be generally similar in principle to that for actuating the elements 35, 33, 36 which move relative to the cutoff roll 20, inasmuch as the transfer pushers are extended and retracted by swinging motion of the above-mentioned rock shaft 40. However, FIGS. 4–6 and 12 illustrate another form of extending and retracting mechanism for the bed roll 18, and it will be understood that an adaptation of the bed roll mechanism here illustrated and now to be described could be used for the mechanism on the cutoff roll.

The rock shaft 40 for the transfer pushers 38, as pointed out hereinabove, is inwardly adjacent to the periphery of the bed roll and is spaced circumferentially forwardly of the pins 32 and the cutting reaction bar 34, to be a substantial distance forward of the pushers 38 themselves. Secured to the rock shaft 40 at intervals along its length are anchoring blocks 64, one for each pusher, to each of which is secured a Z-shaped bracket strip 65 that extends radially relative to the rock shaft 40. The individual finger-like pushers or pads are generally tubular, and each is secured to its bracket strip 65 by a U-shaped clip 66.

The pins 32, as best seen in FIG. 10, comprise U-shaped members that are fixed to the bed roll, and the individual pushers 38 are so spaced along the rock shaft 40 that their forward component of extending motion carries their front end portions into the spaces between pin members.

A tension spring 70 at each end of the bed roll 18 strongly biases the rock shaft 40 for rotation to its position in which the transfer pads 38 are extended. Each spring 70 has one of its ends connected to a bracket 71 (FIGS. 4 and 5) which is fixed on the adjacent end wall 72 of the bed roll and has its opposite end secured to the adjacent anchoring block 64. Normally the rock shaft 40 is held against rotation in its extending direction by means of a solenoid-actuated trigger mechanism comprising an electromagnetically retractable latch bolt 73 and a control lever 74 that has a fulcrum connection 75 to the end wall 72 of the bed roll, to swing about an axis parallel to that of the bed roll. The connection between the rock shaft 40 and the control lever 74 comprises a radially projecting control arm 76 on the rock shaft 40 and a turnbuckle 77 that is connected between the control arm 76 and the control lever 74.

The control lever 74 has three arms that extend from its fulcrum 75, namely a relatively short latching arm 79 that cooperates with the retractable latch bolt 73, another short, oppositely projecting arm 80 to which the turnbuckle 77 is connected, and a relatively long arm 81 on which there is a resetting cam follower roller 82. Normally the retractable latch bolt 73 is extended, as shown in FIGS. 4 and 6, and the spring 70, connected with the control lever 74 through the control arm 76 on the rock shaft and the turnbuckle 77, serves to bias the latching arm 79 of the control lever 74 into engagement with the extended latch bolt 73, which thus prevents rotation of the rock shaft 40 in response to the bias of the spring 70. The latch bolt 73 is biased (FIG. 13) towards its extended position and is retracted in consequence of momentary energization of a solenoid 84 which is mounted on the bed roll end wall 72 and to which the latch bolt 73 is coaxially connected. When it is retracted, the latch bolt 73 moves out from under the latching arm 79 of the control lever 74, and in response to the force which the spring 70 exerts upon it through the control arm 76 and the turnbuckle 77, the control lever 74 moves to its position shown in FIG. 5. With such swinging of the control lever 74 the rock shaft 40 can of course rotate to the position in which the web transfer pushers 38 are extended.

Only a momentary energization of the solenoid 84 is needed. Once the latch bolt 73 is retracted, its extension in response to its bias is blocked by the latching arm 79 of the control lever 74, as can be seen from FIG. 5. To reset the latch, therefore, and simultaneously cause retraction of the transfer pushers 38, the control lever 74 is swung back to its normal position, in which its latching arm 79 is clear of the path of the latch bolt 73, and the latter can extend in response to its bias. For such resetting, the cam follower roller 82 on the long arm 81 of the control lever 74 cooperates with a fixed reset cam 83. Resetting is of course timed to occur at a point in rotation of the bed roll at which the web transfer pushers 38 have moved completely past the new core.

Adjustability of the length of the turnbuckle 77 provides for adjustment of the retracted position of the web transfer pads 38. The distance radially relative to the bed roll 18 through which the pads 38 move in their extension is determined by dimensional parameters of the extending and retracting mechanism. The transfer pads 38 preferably extend a little more than just enough to touch the new core, and their resilience thus enables them to firmly but yieldingly press the web into engagement with that core.

Mandrel Drive Mechanism

As pointed out above, the mandrel 22 that is at the acceleration station C must be accelerated to web transfer speed while the mandrel at the winding station D is being rotated under the application of a controlled torque to it; and a mandrel moving from the acceleration station C to the winding station D must be kept in rotation at the same time that a mandrel which has moved away from the winding station D is being decelerated.

For driving the mandrels in this manner, the apparatus comprises two motors 87, 88 (FIG. 1) which can be energized independently of one another. Starting at an arbitrarily chosen mandrel 22 on the turret 23, the mandrels can be numbered from 1 to 6 around the turret, and one of the two motors 87, 88 serves for driving the odd-numbered mandrels while the other provides drive for the even-numbered ones. In this case motor 87 drives mandrels $22^1$, $22^3$ and $22^5$, comprising the odd-numbered set, while motor 88 drives mandrels $22^2$, $22^4$ and $22^6$, comprising the even numbered set.

Although each motor 87, 88 is arranged for driving all three of the mandrels in its set, and both motors run simultaneously at certain times, neither motor ever drives more than one mandrel at a time. Such selective driving of the mandrels of each set is owing to the nature of the transmission means by which the torque developed by each motor 87, 88 is imposed upon the mandrels of its set.

Figure 15:
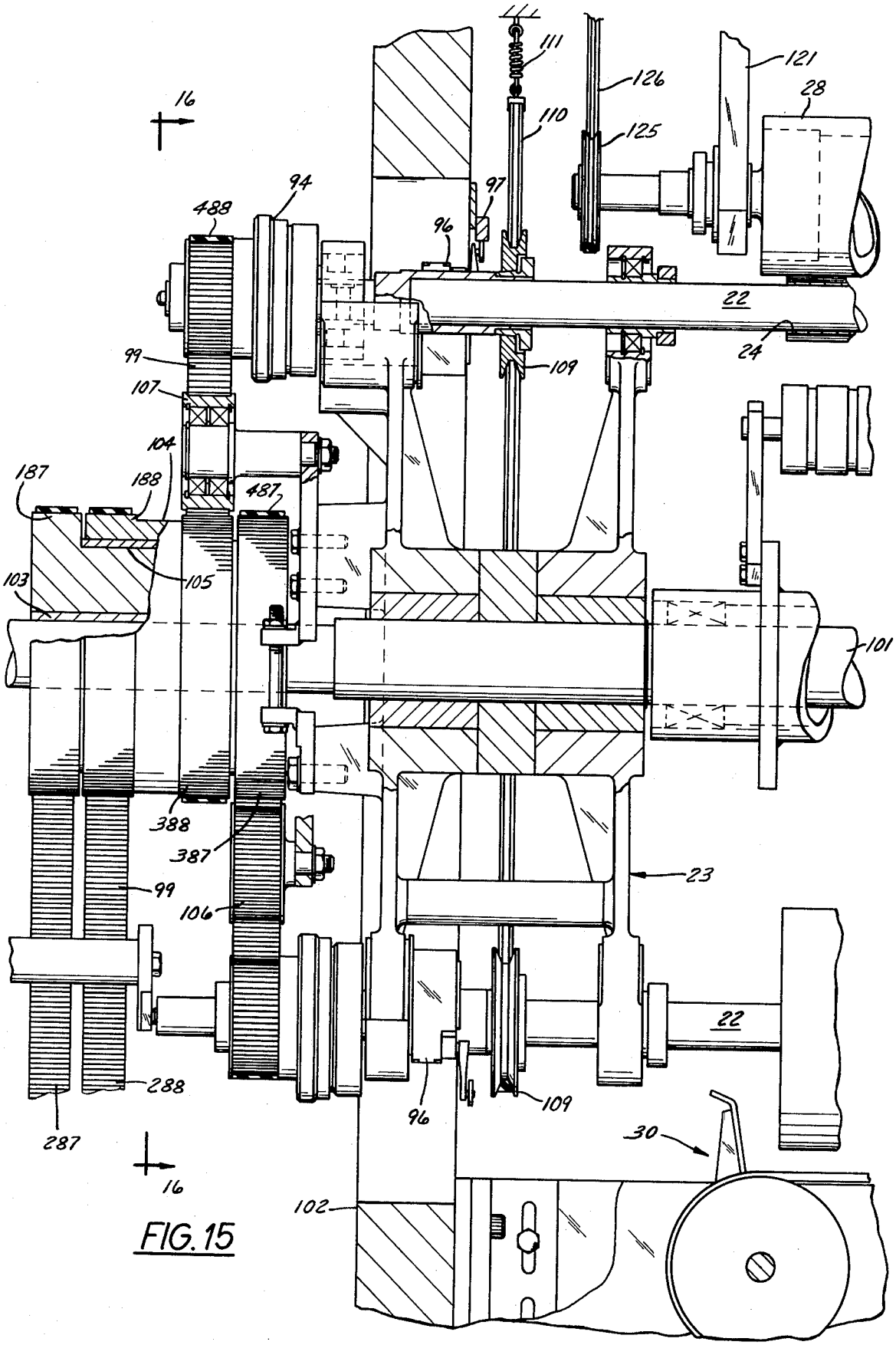
FIG. 15 is a view in vertical section taken on the plane of the line 15—15 in FIG. 2.

For each of the mandrels $22^1$–$22^6$ on the turret 23 there is a sheave $93^1$–$93^6$, respectively, that rotates coaxially with the mandrel and is drivingly connectable with it through a clutch 94, (FIG. 15). The clutches 94 are preferably electromagnetic, but they may be actuated in some other manner. The means for driving the sheaves $93^1$–$93^6$ from the motors 87, 88 comprises two central input pulleys 187, 188 which are rotatable independently of one another on the axis of the turret 23. The input pulleys 187, 188 are connected with the motors 87 and 88, respectively, by means of respective drive belts 287 and 288. For each of the input pulleys 187, 188 there is a coaxial output pulley 387, 388, and each output pulley 387, 388 is constrained to rotate with its input pulley by means of a concentric shaft arrangement which is shown in FIG. 15 and is described hereinafter. By means of a belt 488 the output pulley 388, which is driven by the motor 88, is drivingly connected with the sheaves $93^2$, $93^4$ and $93^6$ for the even-numbered mandrels; and similarly a belt 487 connects the output pulley 387, which is driven by the motor 87, with the sheaves $93^1$, $93^3$ and $93^5$ for the odd-numbered mandrels.

It will now be apparent that if, for example, the motor 88 for the even-numbered mandrels is energized, the three sheaves $93^2$, $93^4$ and $93^6$ will all rotate, but the clutch 94 for one of those mandrels must be engaged in order for rotation to be transmitted to that mandrel from its sheave. For each mandrel there is a normally-open switch 96 on the turret 23 that is actuated by a fixed cam 97 on the machine frame. As a mandrel moves into the acceleration station C, the switch 96 for that mandrel is closed by the cam 97, and such closure of the switch 96 engages the clutch 94 for that mandrel so that the mandrel can be rotatably driven by its sheave 93.

Each of the motors 87, 88 is energized in synchronization with rotation of the bed roll 18, as explained hereinafter. The motor 87 or 88 for the mandrel at the acceleration station C does not begin to run until the mandrel at the winding station D has nearly completed its winding operation, inasmuch as the mandrel at the acceleration station—which is not yet loaded with a web—can come up to winding speed very rapidly. However, the clutch 94 for a mandrel is engaged as soon as the mandrel moves into the acceleration station C, thus eliminating the wear due to engagement of relatively rotating driving and driven clutch members while assuring that the mandrel will begin to rotate as soon as its motor 87 or 88 starts.

During acceleration of a mandrel at the acceleration station C, the circuitry for the motor 87 or 88 which drives that mandrel causes the motor to be controlled for speed (rather than for torque), so that the mandrel will be brought to a speed such that the peripheral speed of the core 24 thereon substantially matches the linear speed of the web 7, for smooth connection of the web to the core at the time of transfer. The mandrel rotates oppositely to the bed roll 18 so that adjacent peripheral portions of the mandrel and bed roll move in the same direction. For winding an untensioned web, the mandrel can be accelerated to a peripheral speed of its core which exactly matches the peripheral speed of the bed roll 18. For tensioned web winding, the peripheral speed to which the core is brought can be sufficiently lower than that of the bed roll for the web to be untensioned during the first few winds onto the new core. The motors 87, 88 are of a known type, each incorporating a control system (not shown) wherein a tachometer generator T driven by the bed roll 18, or driven in synchronism with it, provides a demand value for control of the rotational speed of the mandrel at the acceleration station C.

The circuitry for the motors 87 and 88 is further so arranged that during the last portion of indexing movement of a mandrel into the winding station D, and after the mandrel has made a few turns to ensure good securement of the web to its core, the motor 87 or 88 for that mandrel is energized in its winding mode, in which a controlled torque is applied to the mandrel to maintain a desired web tension. Controlled torque energization continues until the mandrel moves out of the winding station D and web cutoff occurs, whereupon the motor is de-energized. Immediately thereafter the further indexing movement of the mandrel towards the deceleration station E carries its cam-actuated switch 96 out of engagement with the cam 97, so that as the mandrel moves into the deceleration station E, its clutch 94 is disengaged and its motor 87 or 88 is de-energized.

At the deceleration station E the wound mandrel is brought to a stop as described hereinafter.

At this point attention can be given to the details of the above described mandrel drive system.

Figure 17:
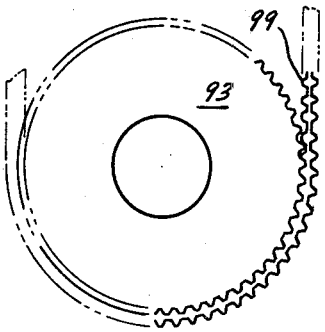
FIG. 17 is a detail view of a portion of the torque transmission by which each mandrel can be driven from its drive motor.

It is important that there be no slippage in the drive transmission to any mandrel 22 from the motor 87 or 88 that drives it, since slippage would be detrimental to maintenance of the required mandrel speed at web transfer and the required torque during winding. Accordingly, the several belts 287, 288, 487 and 488 are all timing belts having regularly spaced transverse lands 99 on their pulley-engaging surfaces; and the several sheaves $93^1$–$93^6$ and pulleys 187, 188, 387, 388, as well as the drive sheaves 587, 588 on the respective motors 87, 88, have transverse grooves in which those belt lands 99 are received, for a gear-like positive drive, as illustrated in FIG. 17. It will be understood that the several belts could be replaced by other suitable endless transmission elements such as chains, and the sheaves and pulleys would correspondingly be replaced by suitable rotary transmission members such as sprockets.

The shaft 101 (FIG. 15) on which the turret 23 is mounted for its indexing rotation projects axially a substantial distance beyond one side of the machine frame 102 that supports it, and the coaxial input pulleys 187, 188 and output pulleys 387, 388 are concentrically carried by this projecting portion of the shaft. The input pulley 187 and its associated output pulley 387 are spaced apart axially by a substantial distance and are both nonrotatably secured to a sleeve 103 which surrounds the turret shaft 101 and is rotatable thereon. The sleeve 103 thus constrains the pulleys 187 and 387 to rotate in unison with one another. The input pulley 188 and its associated output pulley 388 are axially spaced apart by a substantially smaller distance, being axially interposed between the pulleys 187 and 387. An axially short spacer 104 between the pulleys 188 and 388 can be connected to both of them to constrain them to rotation in unison, and they are journaled on a sleeve 105 which concentrically surrounds the sleeve 103. It will be apparent that the coaxial sleeves 103 and 105, and the pulleys respectively carried by them, can rotate independently of one another and of the turret shaft 101; and it will be understood that the sleeves 103 and 105 can comprise ball bearings, roller bearings or the like instead of the plain sleeves here shown.

Figure 16:
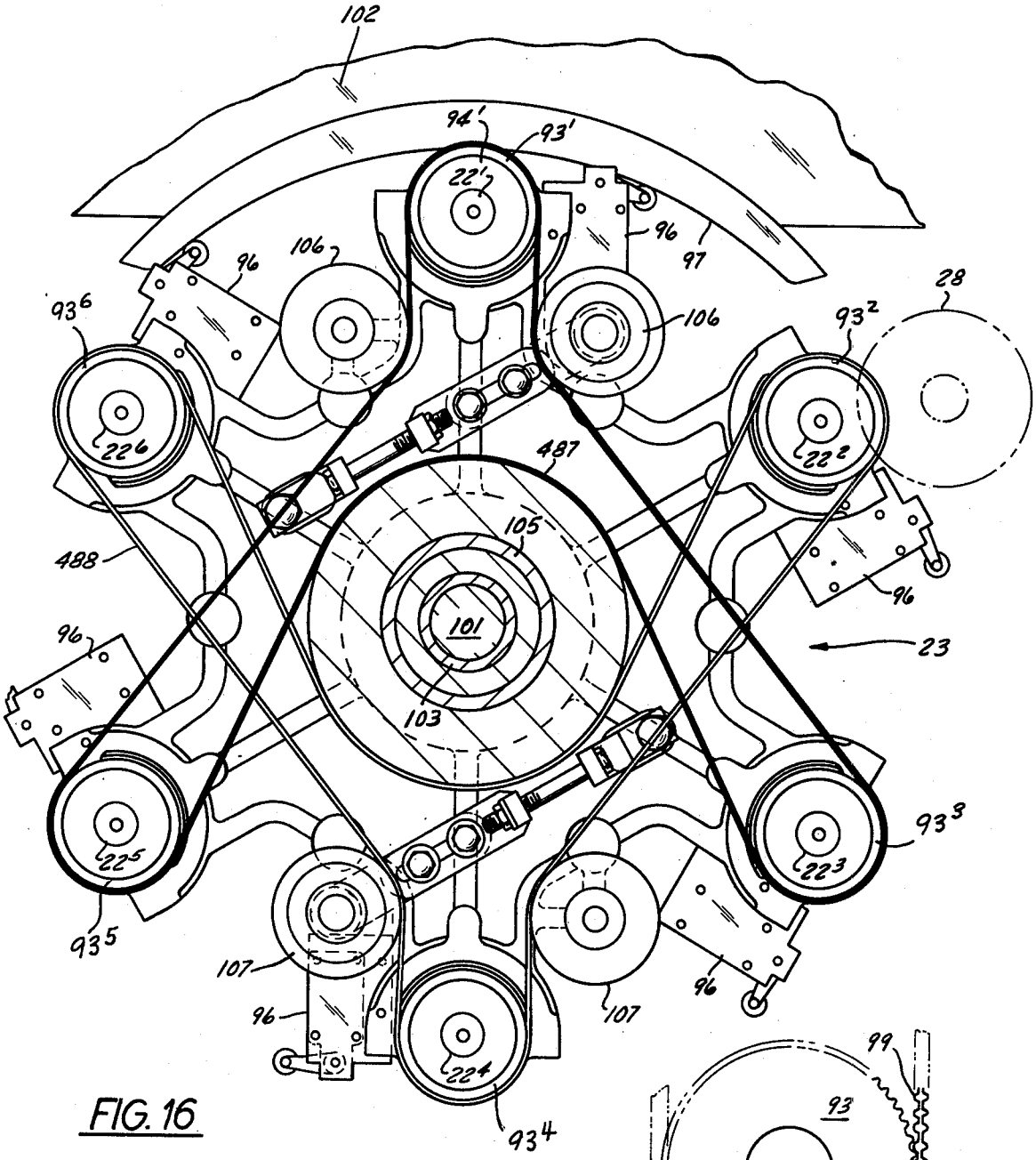
FIG. 16 is a view in vertical section taken on the plane of the line 16—16 in FIG. 15.

As can be seen from FIG. 16, each of the belts 487 and 488 has both inside and outside driving faces and is trained around its three sheaves 93 with its inside face in engagement with those sheaves. Each belt 487, 488 is also wrapped around its output pulley 387, 388, respectively, with its outside face in engagement with that pulley. Idler pulleys 106, 107 are arranged to tension each of the belts 487, 488.

Rider Roll

At the time the leading portion of the web is attached to a new core 24, the mandrel 22 by which that core is supported is in the course of indexing movement from the acceleration station C to the winding station D. Indexing rotation of the turret 23 is in the same direction as bed roll rotation, and therefore the movement of the mandrel immediately after web attachment, which is in the direction opposite to that of web advance, tends to prevent tensioning of the web until it has a few turns around the mandrel. Such indexing movement of the mandrel also tends to partially unwrap the web from around the bed roll 18. However, as best seen from a comparison of FIGS. 4 and 6, a substantial amount of wrap around the bed roll is maintained because as the mandrel moves into the winding station D, the web engages a fixed guide roll 69 whereby the stretch of web extending from the bed roll 18 to the core at the winding station is caused to follow a dog-leg course. The angularity of this dog-leg increases during the final stages of movement into the winding station, to provide for a steady build-up of web tension.

As a mandrel 22 moves into the winding station, the roll of web being wound onto it engages the rider roll 28, which rotates on one end of a carrier arm 121 that has its other end swingably connected to the machine frame (FIGS. 1–6). The rotational axis of the rider roll 28 is parallel to the axes of the mandrels 22, as is the pivot axis about which the carrier arm 121 swings. The carrier arm 121 is biased, as by means of a pneumatic cylinder 122, in the direction to urge the rider roll 28 towards the axis of the mandrel 22 at the winding station D. However, the limit of motion of the rider roll in response to such bias is so fixed that the roll being wound just touches the rider roll as it enters the winding station, thus ensuring that the turret indexing mechanism does not have to work against the pneumatic cylinder 122. But as the roll of web grows with continued winding, the rider roll applies a radially inward pressure to it, to squeeze air out from between its layers.

The rider roll 28 is coated with rubber or a rubber-like material, or is otherwise provided with a frictional peripheral surface, and it is rotatably driven in a direction such that its periphery is moving in the same direction as the web material that it engages, that is, the rider roll 28 rotates oppositely to the mandrel at the winding station. Furthermore, the speed at which the rider roll 28 is rotatably driven is such that its peripheral speed is somewhat faster than web speed, so that the rider roll, by its frictional engagement with the web being wound, augments the torque applied to the mandrel, to increase web tension. Considered from another standpoint, some of the winding torque that is needed for maintenance of a given web tension is applied by means of the rider roll 28, and therefore the winding drive motors 87 and 88 need not be as powerful as if they had to produce all torque needed for winding, nor is it necessary to transmit unduly high torque forces through the connection between the mandrel and the core thereon.

Figure 18:
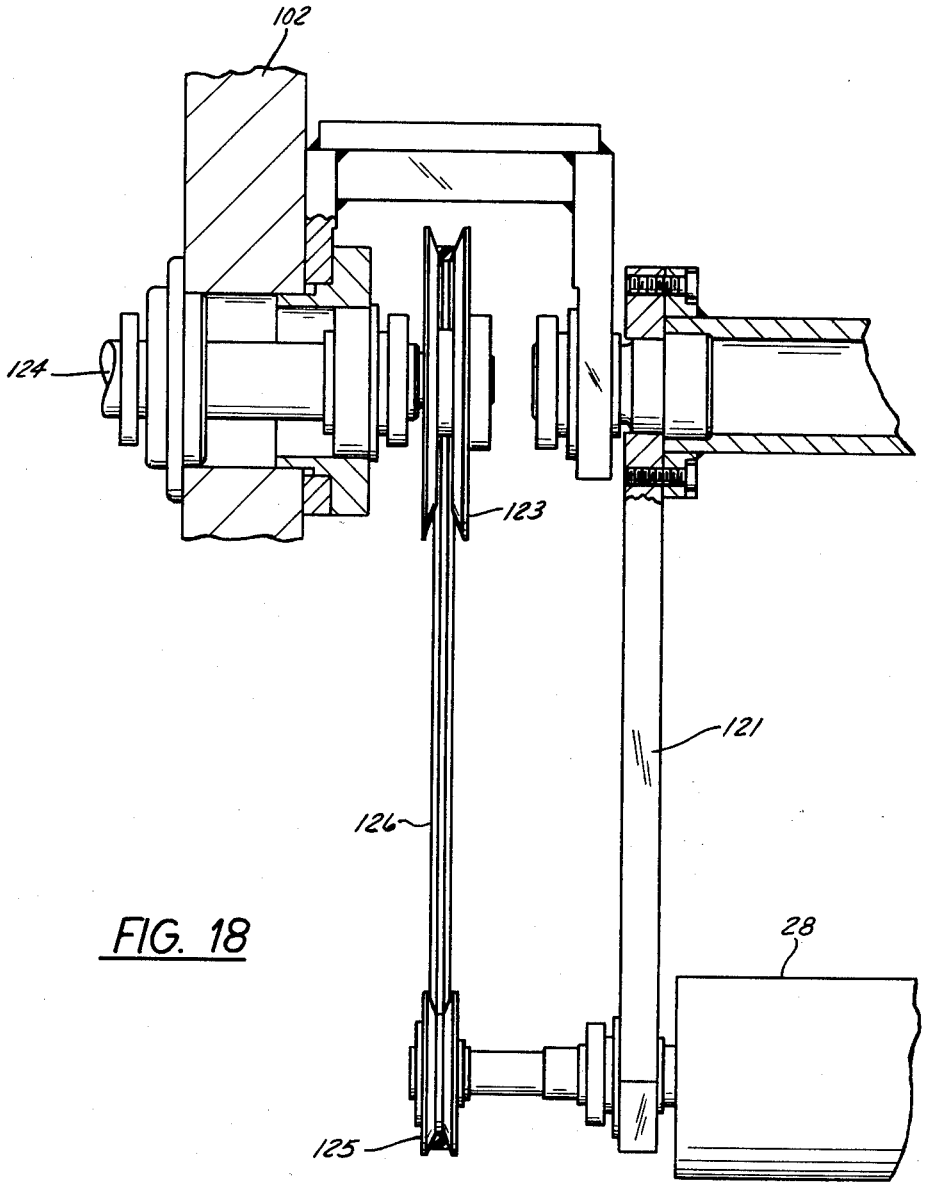
FIG. 18 is a fragmentary sectional view taken on the plane of the line 18—18 in FIG. 2.

Since the rider roll 28 must have a rotational speed which is related to web speed and hence to the rotational speed of the bed roll 18, the drive for the rider roll comprises a sheave 123 that rotates on the axis about which the carrier arm 121 is swingable. Through a suitable driving connection (FIG. 2) between the sheave 123 and a driving member 124 which rotates with the bed roll 18, said sheave is constrained to rotate in synchronism with the bed roll. Another sheave 125 (FIG. 18) that is coaxial with the rider roll 28 and is constrained to rotate therewith is connected with the sheave 123 by means of an endless belt 126. One of the sheaves 123, 125 (in this case the sheave 123) is of the type that comprises axially adjustable conical elements, so that its effective diameter can be adjustingly varied to provide for adjustment of the relationship between web speed and peripheral speed of the rider roll 28. The adjustment of the variable-diameter sheave of course controls the amount of tensioning force that the rider roll tends to apply to the web. It will be evident that winding of an untensioned web can be accommodated by so adjusting the variable-diameter sheave that the rider roll peripheral speed is equal to or less than web speed.

Mandrel Deceleration Means

Secured to each mandrel 22 for rotation with it is a braking sheave 109 (FIG. 15) that is cooperable with a fixed belt 110 for deceleration of the mandrel after the core 24 thereon has been wound. The belt 110 is suspended in a loop which embraces the bottom portion of the mandrel orbit, and its opposite ends are connected to fixed supports on the machine frame through tension springs 111. The loop of the fixed belt 110 is so arranged that it is engaged by the braking sheave 109 on a mandrel 22 as the mandrel is being carried into the deceleration station E. Since the belt 110 is confined against lengthwise motion, except to the limited extent permitted by the tension springs 111, friction between it and the rotating braking sheave 109 brings the mandrel to a stop.

The fixed belt 110 is further so arranged that the braking sheave 109 remains engaged with it as the mandrel 22 moves through the unloading station F and the loading station A, so that the mandrel is confined against rotation as wound cores are unloaded from it and new core stock is loaded onto it. The belt 110 is out of engagement with a mandrel at the gluing and core slitting station B, so that the mandrel is free to be rotated by the glue applicator roll 26 and/or the core slitting roll 25.

Control of Wound Count

From the foregoing explanation it will be evident that cutoff and transfer of the web 7 must take place while indexing rotation of the turret 23 is in progress, and must occur in a particular portion of the indexing advance. Furthermore, the bed roll 18 must be in a particular rotational position at the time of web transfer. Therefore the speed of turret indexing movement must be synchronized with the rotational speed of the bed roll 18.

In the web rewinding apparatus of this invention, the indexing mechanism 115 that effects advancing movement of the turret 23 is driven from a drive shaft 116 that is geared to the bed roll 18 and is thus rotated at a speed which is fixed in a constant relationship to the speed of bed roll rotation. However, the drive shaft 116 is connectable with the indexing mechanism 115 through a clutch-brake mechanism 117 which is preferably actuated electromagnetically. In a clutching condition the clutch-brake 117 couples the drive shaft 116 to the indexing mechanism 115, and in its alternative braking condition it prevents movement of the indexing mechanism 115 without interfering with rotation of the drive shaft 116. The clutch-brake 117 is energizing for its clutching condition at the appropriate time in response to an output from a program controller 118 (FIG. 19) that comprises counter means.

According to the present invention, a known type of pulse generator 119 is connected with the bed roll 18 to issue to the program controller 118 a predetermined number of pulses at each revolution of the bed roll. Typically, the pulse generator 119 issues six pulses for each turn of the bed roll, or a pulse for every 60° of bed roll rotation. These pulses are counted by the program controller 118, which is reset to zero when the pulse count that it contains reaches a value determined by the prevailing adjustment of a manually adjustable reset device 120. Thus, at any instant the pulse count stored in the counter means 118 constitutes a magnitude that corresponds in value to the number of revolutions made by the bed roll 18 from the last resetting of the counter means to that instant.

The program controller 118 is caused to issue an output when the magnitude (pulse count) that it holds attains each of certain fixed values, and these outputs are employed, as explained hereinafter, to initiate certain of the operations performed by the apparatus—and particularly the web cutoff and transfer operations—to thus synchronize those operations with the rotation of the bed roll 18.

The program that is followed from indexing movement to indexing movement is of course a repetitive or cyclical one, and any arbitrary point in the cycle can be taken as a beginning of the cycle, even though that point may not coincide with the actual beginning of winding of a roll. Thus the program cycle that is controlled by the counter means 118 can be considered to begin with resetting of that counter means to cause the pulse count that it holds to be brought to zero, and such resetting can occur at any arbitrarily chosen point in the operating cycle. For purposes of example, it will be assumed that the counter means 118 is reset to zero shortly before the time when a mandrel at the acceleration station C is to be started in rotation.

During a first portion of the program cycle following the issuance of the resetting impulse, the pulse count stored in the counter means 118 attains a succession of values at which various outputs are issued. One of the first of these outputs causes starting of the appropriate motor 87 or 88 for the mandrel at the acceleration station C; or in this case the resetting impulse could be the output which starts that motor. Shortly afterward an output is issued, in response to attainment of a predetermined pulse count, that causes the clutch-brake 117 to be energized for clutching, to couple the drive shaft 116 to the indexing mechanism 115 and thus start an indexing movement. After the drive shaft 116 has made the number of revolutions needed for a complete indexing operation, another output from the counter 118 can cause the clutch-brake 117 to be returned to its braking condition, although preferably this occurs in response to an output from a detector (not shown) which is responsive to the position of the turret so that wear or play in the indexing mechanism will not result in cumulative indexing errors.

Early in the program cycle, at certain pulse counts corresponding to appropriate positions of turret indexing movement and bed roll rotation, outputs are issued that initiate extension of the knife 33 and extension of the web transfer pushers 38. An output issued at a subsequent predetermined pulse count causes a change in the driving mode of the motor 87 or 88 that is rotating the mandrel on which web winding has started. At other predetermined pulse count values, other operations can be initiated and terminated in response to outputs from the program controller 118, as for example the operation of the core slitting and glue applying mechanism.

Although most operations are preferably controlled by outputs from the program controller 118, it will be recognized that certain operations—notably loading and unloading of the mandrels—can be initiated in response to turret position, as with the preferred manner of terminating turret indexing motion.

Although resetting of the counter 118 does not necessarily occur at the beginning of a winding operation, a given footage or count will always have been wound during the interval from one resetting to the next succeeding one, assuming no change is made in the manual reset control 120. Specifically, if the bed roll 18 has a five foot circumference and the pulse counter issues six pulses per bed roll revolution, resetting should occur on pulse No. 600 for the winding of 500-ft. individual rolls.

Those skilled in the art will readily understand how counter elements can be arranged to cooperate in providing the program control counter means 118. It will be recognized that the program controller 118 will normally have provision for a basic or minimum footage or count (or plural alternatively selectable basic quantities), and that the manual reset control 120 enables any selected one of a succession of increments to be added to the basic quantity. For example, with a 500-ft. basic length and a 5-ft.-circumference bed roll, the operator will be able to select from among a zero increment, a 5-ft. increment (505-ft. roll), a 10-ft. increment, and possibly also 15- and 20-ft. increments. Obviously provision can be made for many other selection possibilities. It will be recognized that the increment selection can be changed while winding is in progress, without any need for stopping the machine.

The total cycle length, from one resetting of the program control counter means 118 to the next successive one, can be varied by means of the manual reset control, but there is a certain portion of the cycle during which outputs are issued at fixed and substantially invariable intervals. In the present illustration, wherein each indexing movement occurs at or shortly after the time that the counter means 118 is reset to zero, these outputs are issued during the first part of the cycle, and they control events which must be accurately synchronized with one another, including the events involved in web cutoff and transfer. During the remainder of each cycle nothing is taking place except winding, and, in effect, it is the duration of that remaining portion of the cycle which is controlled by the manually adjustable resetting device 120 because of the fixed and invariable timing of events during the first portion of the cycle.

From the foregoing explanation taken with the accompanying drawings it will be apparent that this invention provides high-speed automatic web rewinding apparatus that is capable of maintaining substantial tension on the web being rewound, for production of very compact hard-wound rolls, but is also suitable for other types of rewinding. It will be further apparent that the apparatus of this invention provides for quick and easy adjustment of the length of web stock to be wound onto each individual roll.

What is claimed as the invention is:

1. Web rewinding apparatus of the type comprising a plurality of mandrels which are movable in succession along a defined path and each of which can support a tubular core for web winding rotation, a bed roll which rotates in one direction about a fixed axis adjacent to said path and around which a web has wrapping engagement as it moves towards a core on one of said mandrels to be wound thereonto, a cutoff roll adjacent to said bed roll and constrained to rotate oppositely to the bed roll in synchronism therewith, a knife carried by one of said rolls and cooperable with reaction means on the other roll for cutting through the web to terminate winding thereof around one of said mandrels and produce a free leading portion on the web that can be attached to a new core on the next successive mandrel for winding thereonto, pins carried by the bed roll upon which said leading portion is impaled substantially simultaneously with cutting through the web, and transfer pad means carried by the bed roll for substantially radial extending and retracting motion whereby said leading portion of the web is disengaged from said pins and forced into engagement with said new core, said web rewinding apparatus being characterized by:

A. said knife being carried by said cutoff roll for extending and retracting movement relative thereto and being receivable, when extended, in an opening in said bed roll;

B. said pins being fixed on the bed roll, in said opening therein; and

C. substantially blunt web impalement pusher means carried by said cutoff roll for extending and retracting movement relative thereto substantially in unison with said knife, whereby said leading portion of the web is forced radially inwardly relative to the bed roll and into impalement upon said pins at substantially the same time that the web is cut through by the knife.

2. The web rewinding apparatus of claim 1 wherein said transfer pad means is carried by the bed roll for extending and retracting motion about a pivot axis, further characterized by:

the transfer pad means being spaced a substantial distance behind said pivot axis relative to said direction of rotation of the bed roll, so that extending motion of the transfer pad means has a circumferentially forward component.

3. A web winding machine of the type that comprises a plurality of mandrels which are moveable in succession along a defined path and each of which can support a tubular core for web winding rotation, and web guiding means by which a web is confined to movement in one direction towards a portion of said path, said web guiding means comprising a bed roll which rotates in one direction about a fixed axis adjacent to said path and around which the web has wrapping engagement, said web winding machine being characterized by:

A. web cutting means for cutting through the web to terminate winding thereof onto a core on one of said mandrels and to provide a free leading portion of the web that can be attached to a new core on the next successive mandrel for winding therearound, said web cutting means comprising (1) a cutoff roll adjacent to said bed roll, rotatable in synchronism with the bed roll and in the opposite direction, and (2) a knife carried by said cutoff roll for rotation therewith and for substantially radial extension and retraction relative thereto, (3) said bed roll having an axially extending slot opening to its periphery in which said knife, when extended, is receivable;

means for controlledly carrying the free leading portion of the web towards engagement with said new core, comprising (1) impalement pins fixed to the bed roll, in said slot therein, upon which said free leading portion of the web is impaled substantially simultaneously with cutting through of the web, and (2) web impalement pusher means carried by said cutoff roll for substantially radial extending and retracting movement substantially in unison with said knife, for impaling a free leading portion of the web upon said pins; and C. means for transferring the free leading portion of a web from the bed roll to said new core, comprising transfer pad means carried by the bed roll for extending and retracting motion about a pivot axis and spaced a substantial distance behind said pivot axis relative to said direction of rotation of the bed roll so as to extend and retract with substantial components of circumferential motion.

4. The web rewinding machine of claim 3 wherein said transfer pad means comprises a plurality of elongated finger-like members that extend circumferentially relative to the bed roll and are laterally spaced apart along the bed roll, further characterized by:

said transfer pad means and said pivot axis being so arranged that front end portions of said finger-like members (1) are spaced behind said pins when the transfer pad means is retracted and (2) are interposed between said pins when the transfer pad means is extended.

5. A web rewinding machine of the type that comprises a plurality of mandrels which are moveable in succession along a defined path and each of which can support a tubular core for web winding rotation, a bed roll which rotates in one direction about a fixed axis adjacent to said path and around which a web has wrapping engagement to be constrained to movement towards a portion of said defined path, a cutoff roll adjacent to said bed roll and constrained to rotate in synchronism with the bed roll but in the opposite direction, a knife carried by one of said rolls and cooperable with reaction means on the other of said rolls for cutting through a web to terminate winding thereof around one of said mandrels and provide a free leading portion on the web that can be attached to a new core on the next successive mandrel for winding thereonto, web impalement pins carried by the bed roll and upon which said leading portion is impaled substantially simultaneously with cutting through the web, and circumferentially projecting transfer fingers carried by the bed roll for substantially radial extension and retraction whereby said leading portion of the web is disengaged from said pins and forced into engagement with said new core, said web rewinding machine being characterized by:

A. said pins being fixed in the bed roll, in a lengthwise extending slot therein, so that a free leading portion of a web that is impaled on said pins extends obliquely radially inwardly relative to the bed roll; and B. web impalement pusher means carried by said cutoff roll for rotation therewith and for substantially radial extending and retracting motion relative thereto, whereby said leading portion of a web is forced flatwise radially inwardly relative to the bed roll to be impaled on said pins.

6. The web rewinding machine of claim 5, further characterized by:

C. said knife being carried by said cutoff roll for substantially radial extending and retracting motion relative thereto in unison with said web impalement pusher means, and being receivable in said slot in the bed roll.

7. Web rewinding apparatus comprising a plurality of mandrels which are moveable in succession along a defined path and each of which can support a tubular core for web winding rotation, a bed roll which rotates in one direction about a fixed axis adjacent to said path and about which a web has wrapping engagement to be constrained to move towards a portion of said defined path, means for cutting through the web to terminate winding thereof around one of said mandrels and to provide a free leading portion on the web that can be attached to a new core on the next successive mandrel for winding thereonto, web impalement pins carried by the bed roll and upon which said leading portion is impaled at substantially the same time that the web is cut through, finger-like transfer pads that are elongated circumferentially of the bed roll and means on the bed roll by which said transfer pads are carried for substantially radial motion relative to the bed roll to and from an extended position at which said leading portion of the web is detached from the pins and the transfer pads force it into engagement with said new core, said web rewinding apparatus being characterized by:

said means on the bed roll being so arranged that the transfer pads have a component of circumferential forward motion in said one direction relative to the bed roll during their motion to said extended position, whereby front end portions of said transfer pads are carried forwardly between the pins from a rearwardly spaced relationship to the pins.

8. The web rewinding apparatus of claim 7, further characterized by:

said means on the bed roll comprising a rock shaft having its pivot axis parallel to said axis of the bed roll and radially inwardly adjacent to the bed roll periphery, said rock shaft being spaced circumferentially in said direction a substantial distance from the transfer pads.

9. The web rewinding apparatus of claim 8 wherein said means for cutting through the web comprises a cutoff roll rotatable about a fixed axis which is adjacent to the bed roll and rotates in the opposite direction, further characterized by:

said means for cutting through the web further comprising a knife which is carried by said cutoff roll for substantially radial extension and retraction relative thereto and which, when extended, is received in an axially extending radially outwardly opening slot in the bed roll.

10. The web rewinding apparatus of claim 9 wherein said pins are fixed in said slot in the bed roll, further characterized by:

a web impalement pusher bar carried by said cutoff roll for motion relative thereto substantially in unison with said knife and which, when extended, forces said leading portion of a web into impalement upon said pins.

11. Web rewinding apparatus comprising a plurality of mandrels which are moveable in succession along a defined path and each of which can support a tubular core for web winding rotation, a bed roll which rotates in one direction about a fixed axis adjacent to said path and around which a web has wrapping engagement as it moves towards a core on one of said mandrels to be wound thereonto, means for cutting through a web to terminate winding thereof around one of said mandrels and provide a free leading portion on the web that can be attached to a new core on the next successive mandrel for winding thereonto, radially outwardly projecting pins carried by the bed roll, spaced from one another along an axially extending row and upon which said leading portion of the web is impaled at substantially the same time that the web is cut through, and circumferentially extending finger-like transfer pads carried by the bed roll for extending and retracting motion whereby said leading portion of the web is disengaged from said pins and forced into engagement with said new core, said rewinding apparatus being characterized by:

said transfer pads being mounted on the bed roll for extending and retracting swinging motion relative to the bed roll about an axis which is spaced forwardly in said direction of bed roll rotation from the pins.

12. The web rewinding apparatus of claim 11, further characterized by:

said transfer pads being arranged to have their forward portions move between the pins during their extending motion.

13. Web rewinding apparatus for producing hard-wound individual rolls from web stock unwound from a parent roll, comprising a mandrel rotatable in one direction and on which a tubular core can be supported and means for constraining web stock to advance towards said mandrel at a predetermined speed so that a substantial tension can be maintained in web stock being wound onto said core, said web rewinding apparatus being characterized by:

A. a rider roll having a peripheral friction surface, said rider roll (1) being mounted for bodily movement towards and from the mandrel with its axis at all times parallel to that of the mandrel, and (2) being yieldingly biased towards the mandrel to exert radially inward force upon web stock being wound around the mandrel; and B. means for rotatably driving the rider roll (1) in the direction opposite to said direction of mandrel rotation so that said surface of the rider roll moves in the same direction as web stock engaged thereby and (2) at a rate such that the peripheral speed of said surface of the rider roll is higher than said speed of web stock advance, so that the rider roll, by its frictional engagement with web stock wound around the mandrel, tends to maintain a desired tension in the web stock moving towards the mandrel.

14. Web rewinding apparatus of the type wherein a mandrel on which a tubular core is supported is rotatably driven in such a manner that web stock being wound onto said core is maintained under lengthwise tension to produce a hard-wound roll, and wherein a rider roll which has its axis parallel to that of the mandrel is biased into engagement with web stock wound around the mandrel to force air out from between the coils thereof, said web rewinding apparatus being characterized by:

means for rotatably driving said rider roll (1) in the direction opposite to that of mandrel rotation, so that the peripheral surface of the rider roll moves in the same direction as wound web stock with which it is engaged, and (2) at a rate such that the peripheral speed of said surface is faster than the speed of the web stock with which it is engaged, so that the rider roll tends to increase tension in the web stock moving towards the mandrel.

15. The web rewinding apparatus of claim 15, further characterized by:

said rider roll having rubber-like material on its peripheral surface so that it has frictional engagement with web stock wound onto said mandrel.

16. Web rewinding apparatus for producing hard wound individual rolls from web stock unwound from a parent roll, comprising a mandrel on which a tubular core can be supported and which is rotatable about its axis to provide for winding of web stock onto said core, said web rewinding apparatus being characterized by:

A. web control roller means defining a path along which web stock from a parent roll is guided towards said mandrel and is constrained to advance toward said mandrel at a predetermined speed;

B. mandrel drive means for applying to said mandrel a predetermined torque that causes web stock being wound around the mandrel to be maintained under tension;

C. a rider roll which is
(1) bodily movable towards and from the mandrel with its axis at all times parallel to that of the mandrel and
(2) yieldingly biased towards the mandrel to exert radially inward force upon web stock being wound around the mandrel; and D. rider roll drive means for rotating the rider roll
(1) in the direction opposite to that of mandrel rotation so that the peripheral surface of the rider roll moves in the same direction as web stock engaged thereby and
(2) at a peripheral speed which is higher than said predetermined speed of web advance so that the rider roll, by friction with wound web stock that it engages, tends to increase the torque applied to the core on the mandrel and thus increases the tension in web stock being wound around the mandrel.

17. The web rewinding apparatus of claim 16 wherein said rider roll drive means comprises a rotation transmitting connection between said roller means and the rider roll, said connection comprising a pair of spaced apart pulleys and an endless belt trained around said pulleys, further characterized by:

one of said pulleys being adjustably variable as to its effective diameter to provide for adjustment of the difference between the peripheral speed of the rider roll and the speed of advance of the web stock.

18. The method of producing hard-wound individual rolls with web rewinding apparatus wherein a mandrel supports a tubular core to have web stock rewound thereonto from a parent roll, the mandrel is driven for rotation about its axis in a manner to maintain substantial tension in the web stock moving towards said core, and a rider roll that has its axis parallel to the axis of the mandrel is maintained in yieldingly biased engagement with web stock wound around the core to displace air out from between the coils thereof, said method being characterized by:

so driving said rider roll that its rotation
(1) is in the direction opposite to that of mandrel rotation, so that the portion of the peripheral surface of the rider roll that is engaging the wound web stock is moving in the same direction as that web stock, and
(2) at a speed such that said portion of peripheral surface is moving faster than the web stock engaged thereby and thus frictionally tends to increase tension in the web stock moving towards the mandrel.

19. The method of producing hard-wound individual rolls with web rewinding apparatus wherein a rotatable mandrel supports a tubular core to have web stock rewound thereonto from a parent roll, and a rider roll that has its axis parallel to that of the mandrel is maintained engaged under bias against web stock that has been wound around the mandrel to displace air out from between the coils of the web stock, said method being characterized by:

A. constraining web stock moving towards the mandrel to maintain a predetermined substantially constant speed of advance;

B. applying to the mandrel a predetermined torque whereby tension is maintained in web stock being wound around the mandrel; and C. driving said rider roll for rotation
(1) in the direction opposite to that of mandrel rotation and
(2) at a peripheral speed higher than said speed of advance so that the rider roll, by its frictional engagement with web stock wound onto the mandrel, tends to increase the torque applied to the mandrel and the tension in web stock being wound onto the mandrel.

20. Web winding apparatus of the type comprising a turret on which a plurality of rotatable mandrels are spaced at uniform circumferential intervals and which revolves indexingly to carry each mandrel in turn to each of a succession of fixed stations, one of which is an acceleration station whereat the mandrel is brought up to a predetermined rotational speed and the next of which is a winding station whereat torque is applied to the mandrel for winding a web onto it under tension, said web winding apparatus being characterized by:

A. said turret having an even number of mandrels thereon, comprising odd-numbered mandrels alternating with even-numbered mandrels circumferentially around the turret;

B. two motors, one for said odd-numbered mandrels, the other for said even-numbered mandrels;

C. a plurality of drivers, one for each mandrel, carried by said turret for indexing revolution therewith and for rotation relative thereto;

D. transmission means at all times providing a driving connection between each of said motors and the respective drivers for its mandrels;

E. a plurality of clutches carried by said turret, one for each mandrel, each said clutch being engageable to connect its mandrel with the driver for its mandrel so that the mandrel is constrained to rotate with the driver, said clutches normally being disengaged so that each driver can rotate freely relative to its mandrel; and F. clutch actuating means for each clutch, carried by the turret and cooperating with clutch control means fixed with respect to the stations, for engaging each clutch as its mandrel is carried into said acceleration station and disengaging the clutch upon movement of its mandrel away from the winding station.

21. The web winding apparatus of claim 20 wherein each of said drivers comprises a sheave, further characterized by said transmission means comprising:

(1) a pair of input pulleys concentrically arranged on the axis of revolution of said turret and rotatable independently of one another, there being one of said input pulleys for each of said motors, each having an endless belt connection with its motor;
(2) a pair of output pulleys that are concentric to said input pulleys, one for each input pulley and each constrained to rotate with its input pulley, each output pulley having an endless belt connection with each of the drivers of the mandrels for the motor with which its input pulley is connected.

22. The web winding apparatus of claim 21 wherein each of said belt connections comprises a non-slip timing belt.

23. Web winding apparatus wherein a plurality of rotatable mandrels that are spaced circumferentially around a turret are carried orbitally by indexing rotation of the turret to each in turn of a succession of fixed stations, and wherein mandrels at two adjacent ones of said stations must be driven at the same time in respectively different driving modes, said apparatus being characterized by:

A. a plurality of drivers on the turret, one for each mandrel, each driver being rotatable relative to its mandrel;

B. a clutch on the turret for each driver, each clutch being engageable to drivingly connect its driver with its mandrel but being normally disengaged;

C. a pair of motors, each energizable for driving in each of said modes;

D. first transmission means providing a substantially slipless and uninterrupted driving connection between one of said motors and alternate drivers around the turret;

E. second transmission means providing a substantially slipless and uninterrupted driving connection between the other of said motors and the remainder of the drivers on the turret; and F. clutch actuating means for each of said clutches, cooperable with clutch control means fixed with respect to said stations, whereby each clutch is engaged as its mandrel moves into one of said pair of stations and is disengaged as its mandrel moves away from the other of said pair of stations.

24. In web winding apparatus comprising a plurality of rotatable mandrels that are spaced circumferentially around a turret which rotates indexingly about an axis, to be carried orbitally to each in turn of a succession of fixed stations, one of which is a winding station, transmission means whereby each of certain of said mandrels, when it is at said winding station, is rotatably driven from a motor independently of the rotation of all other mandrels, said transmission means comprising:

A. a plurality of rotatable drivers carried by said turret, one for each of said certain mandrels;

B. a clutch for each of said drivers, each clutch being carried by said turret and being engageable to drivingly connect its driver with the mandrel therefor;

C. rotary torque transmitting means rotatable about said axis and cooperable with endless drive elements;

D. a first endless drive element at all times drivingly connecting said motor with said rotary torque transmitting means;

E. a second endless drive element trained around said rotary torque transmitting means and each of said drivers so that all of said drivers at all times have a driving connection with said motor; and F. clutch actuating means for each of said clutches, each clutch actuating means being cooperable with clutch control means fixed with respect to said stations to engage each of said clutches during movement of its mandrel towards said winding station and disengage the clutch during movement of its mandrel away from the winding station.

25. In web winding apparatus comprising a turret that rotates indexingly about an axis, a rotatable mandrel mounted on said turret to be carried orbitally to each in turn of a succession of fixed stations one of which is a winding station, and a motor which is at a location that is fixed with respect to said stations and which is capable of producing a predetermined torque, transmission means whereby substantially the full torque developed by said motor can be imposed upon said mandrel while it is at said winding station so that the mandrel can wind a web under a predetermined tension, said transmission means being characterized by:

A. a driver rotatably mounted on said turret in spaced relation to said axis and adjacent to said mandrel;

B. a clutch on said turret, engageable to provide a rotation transmitting connection between said driver and said mandrel, said clutch being normally disengaged so that the driver can rotate freely relative to the mandrel;

C. clutch actuating means on said turret, operatively associated with said clutch and cooperable with clutch control means fixed with respect to said stations to engage said clutch as said mandrel approaches the winding station and to maintain said clutch engaged while the mandrel remains at the winding station;

D. a torque transmitting element rotatable concentrically to said axis;

E. first substantially slipless torque transmitting means drivingly connecting said motor with said torque transmitting element; and F. second substantially slipless torque transmitting means drivingly connecting said torque transmitting element with said driver.

26. The web winding apparatus of claim 24 wherein another of said stations, to which each mandrel is carried after it leaves the winding station, is a deceleration station, further characterized by:

G. a sheave on each mandrel, constrained to rotate with it; and

H. a substantially stationary belt arranged to be engaged by each sleeve as its mandrel is moved to said deceleration station and by friction with which the rotation of the mandrel is decelerated.

27. The web winding apparatus of claim 25, further characterized by:

G. a sheave coaxially connected with said mandrel for rotation with it; and

H. a substantially stationary belt arranged to be engaged by said sheave as said mandrel moves away from said winding station and, by friction with said sheave, to decelerate the rotation of said mandrel.

28. Web winding apparatus of the type comprising a plurality of mandrels each of which can support a tubular core for web winding rotation, carrier means on which said mandrels are rotatably supported, indexing mechanism for effecting advancing movements of the carrier means to carry each mandrel in turn to each of a succession of stations, one of which is a winding station, and to maintain each mandrel at each station through a dwell, and means for cutting through a web to terminate winding thereof onto a mandrel moving out of said winding station and for transferring the web to a mandrel moving into said winding station, the last mentioned means comprising a bed roll rotatable on a fixed axis and around which the web has substantial wrap as it moves towards a mandrel onto which it is wound so that a known length of web is wound onto that mandrel with each revolution of the bed roll, said web winding apparatus being characterized by:

A. resettable counter means operatively connected with the bed roll to store a magnitude corresponding to the number of revolutions made by the bed roll next following each resetting of said counter means, said counter means being arranged to issue an output when said magnitude attains a fixed value;

B. adjustable resetting means for resetting said counter means to a zero value of said magnitude upon said magnitude attaining a selected one of a plurality of different values higher than said fixed value;

C. a drive member constrained to move at a speed having a fixed relationship to the speed of bed roll rotation and from which said indexing mechanism can be driven to cause the carrier means to make its advancing movements at a speed synchronized with the speed of bed roll rotation; and D. a clutch connected with said counter means to receive said output therefrom and arranged to drivingly connect said drive member with said indexing mechanism in response to receipt of said output, so that the number of revolutions of the bed roll that occur between the beginnings of successive advancing movements of the carrier means is dependent upon the adjustment of said resetting means.

29. Web winding apparatus of the type comprising a plurality of mandrels each of which can support a tubular core for web winding rotation, carrier means on which said mandrels are rotatably supported, indexing mechanism for effecting advancing movements of the carrier means to carry each mandrel in turn to each of a succession of stations, one of which is a winding station, and to maintain each mandrel at each station through a dwell, and means for cutting through a web to terminate winding thereof onto a mandrel moving out of said winding station and for transferring the web to a mandrel moving into said winding station, the last mentioned means comprising a bed roll rotatable on a fixed axis and around which the web has substantial wrap as it moves towards a mandrel onto which it is wound so that a known length of web is wound onto that mandrel with each revolution of the bed roll, said web winding apparatus being characterized by:

A. a drive member constrained to move at a speed that has a fixed relationship to the speed of bed roll rotation and connectable with said indexing mechanism to so drive the same that advancing movement of the carrier means occurs at a speed synchronized with the speed of bed roll rotation;

B. a clutch arranged for connecting said drive member with said indexing mechanism upon receipt of an input;

C. a pulse generator operatively connected with the bed roll to issue a predetermined number of pulses for each revolution of the bed roll;

D. resettable counter means for storing pulses issued by said pulse generator and arranged to issue said input to said clutch when a predetermined fixed number of pulses has been stored following resetting of the counter means; and E. manually adjustable resetting means for resetting said counter means to zero when the count of pulses stored in it attains any selected one of a plurality of different values, all of which are higher than said fixed value, so that the number of revolutions of the bed roll that occur between the beginnings of successive advancing movements of the carrier means is dependent upon the adjustment of said resetting means.

30. The method of rewinding a web from a parent roll onto tubular cores by means of apparatus comprising a plurality of mandrels, each of which can support a core for rotation, carrier means on which said mandrels are rotatably supported, indexing mechanism for effecting advancing movements of the carrier means to carry each mandrel in turn to each of a succession of stations, one of which is a winding station, and to maintain each mandrel at each station through a period of dwell, and means for cutting through a web to terminate winding thereof onto a mandrel moving out of said winding station and for transferring the web to a mandrel moving into said winding station, the last mentioned means comprising a bed roll rotatable on a fixed axis and around which the web has substantial wrap as it moves towards a mandrel onto which it is wound so that a known length of web is wound onto that mandrel with each revolution of the bed roll, said method being characterized by:

A. constraining a drive member that is connectable with said indexing mechanism to at all times move at a speed which is in a fixed relationship to the speed of bed roll rotation so that upon connection of said drive member to the indexing mechanism the carrier means will be advanced at a speed that is synchronized with the speed of bed roll rotation;

B. beginning at a resetting instant which occurs during each period of dwell, counting the number of revolutions made by the bed roll;

C. each time the counted number of bed roll revolutions attains a predetermined substantially invariable value, connecting said drive member with the indexing mechanism to initiate an advance of the carrier means; and D. so adjusting the total number of revolutions made by the bed roll from each resetting instant to the next successive one that a predetermined length of web is wound onto each core that is carried through the winding station.

31. The web winding apparatus of claim 24 wherein another of said stations, to which each mandrel is carried after it leaves the winding station, is a deceleration station, further characterized by:

G. a rotary braking member on each mandrel that is constrained to rotate with the mandrel and has a circumferential friction surface concentric to the mandrel; and H. a substantially stationary braking member arranged to be engaged by the friction surface on each rotary braking member as its mandrel is moved to said deceleration station and which cooperates with the rotary braking member to frictionally decelerate rotation of the mandrel.

32. The web winding apparatus of claim 25, further characterized by:

G. a rotary braking member connected with said mandrel for rotation with it and having a friction surface that is coaxial with it; and H. a substantially stationary brake member arranged to be engaged by said friction surface on the rotary braking member as said mandrel moves away from said winding station and which, by friction therewith, decelerates the rotation of said mandrel.

33. Web rewinding apparatus comprising a turret which supports circumferentially spaced rotatable core carrying mandrels and which revolves indexingly in one direction to carry each mandrel in turn to each of a succession of fixed stations, one of which is a winding station, means for rotatably driving each mandrel as it moves to the winding station and while it is at the same to enable web to be wound onto a core on the mandrel, and web guidance and transfer means comprising a rotary bed roll whereby web is constrained to advance towards the winding station at a predetermined speed so that tension can be maintained on the web during winding and whereby the web is cut through to terminate winding onto a mandrel moving out of the winding station and is immediately thereafter transferred to a mandrel moving into the winding station, said web rewinding apparatus being characterized by:

A. the direction of rotation of each mandrel as it moves towards the winding station and while it is at the same being opposite to the direction of rotation of the bed roll, so that adjacent surface portions of the bed roll and of a core carried by the mandrel are moving in the same direction to facilitate web transfer; and B. said direction of indexing revolution of the turret being the same as the direction of bed roll rotation so that as a mandrel is carried into the winding station its bodily motion tends to relieve tension on the web.

* * * * *